US008861315B2

(12) United States Patent
Hagita et al.

(10) Patent No.: US 8,861,315 B2
(45) Date of Patent: Oct. 14, 2014

(54) RADIO-CONTROLLED WRISTWATCH

(75) Inventors: Takushi Hagita, Tokorozawa (JP); Akira Kato, Sayamashi (JP)

(73) Assignees: Citizen Holdings Co., Ltd., Tokyo (JP); Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 14/007,862

(22) PCT Filed: Mar. 13, 2012

(86) PCT No.: PCT/JP2012/056395
§ 371 (c)(1),
(2), (4) Date: Sep. 26, 2013

(87) PCT Pub. No.: WO2012/132874
PCT Pub. Date: Oct. 4, 2012

(65) Prior Publication Data

US 2014/0010053 A1 Jan. 9, 2014

(30) Foreign Application Priority Data

Mar. 31, 2011 (JP) ..... 2011-079890

(51) Int. Cl.

| | |
|---|---|
| ***G04B 1/00*** | (2006.01) |
| ***G04C 10/02*** | (2006.01) |
| ***G04R 20/04*** | (2013.01) |
| ***G04G 21/04*** | (2013.01) |
| ***G04G 19/00*** | (2006.01) |

(52) U.S. Cl.
CPC ..... *G04G 21/04* (2013.01); *G04C 10/02* (2013.01); *G04R 20/04* (2013.01); *G04G 19/00* (2013.01)
USPC ..... 368/205; 368/47

(58) Field of Classification Search
USPC ..... 368/47, 203–205; 342/357.22, 357.23, 342/357.24
See application file for complete search history.

(56) References Cited

U.S. PATENT DOCUMENTS 7,102,964 B2 * 9/2006 Fujisawa ..... 368/66
7,148,844 B2 * 12/2006 Salkhi ..... 342/357.62
(Continued)

FOREIGN PATENT DOCUMENTS

JP 60-185188 A 9/1985
JP 61-241690 A 10/1986
(Continued)

OTHER PUBLICATIONS

International Search Report of PCT/JP2012/056395, dated Jun. 5, 2012.
Written Opinion issued in corresponding PCT/JP2012/056395 dated Oct. 10, 2013.

*Primary Examiner* — Sean Kayes
(74) *Attorney, Agent, or Firm* — Sughrue Mion, PLLC

(57) ABSTRACT

A radio-controlled wristwatch that determines whether or not illuminance of light irradiating a solar cell is high, using plural criteria but without directly measuring voltage or current. The wristwatch includes: a solar cell; a control circuit which stops operation under a predetermined condition; and an illuminance detection circuit which indicates illuminance of light irradiating the solar cell being higher than a given threshold value. The wristwatch switches the given threshold value between a first and a second value, larger than the first value, starts the control circuit in a stop state when a signal indicating that the illuminance is higher than the first value is output, receives a satellite signal containing time information from a satellite when a signal indicating that the illuminance is higher than the second value is output, and displays time corresponding to the time information contained in the received satellite signal.

14 Claims, 16 Drawing Sheets

(56) References Cited

U.S. PATENT DOCUMENTS

| | | | | |
|---|---|---|---|---|
| 7,317,418 | B2 * | 1/2008 | Salkhi | 342/357.62 |
| 7,920,441 | B2 * | 4/2011 | Rostrom | 368/47 |
| 8,432,771 | B2 * | 4/2013 | Matsuzaki | 368/47 |
| 2004/0100870 | A1 | 5/2004 | Igarashi et al. | |
| 2010/0220555 | A1 | 9/2010 | Honda | |

FOREIGN PATENT DOCUMENTS

| | | | |
|---|---|---|---|
| JP | 2003-130973 | A | 5/2003 |
| JP | 2010-203856 | A | 9/2010 |
| WO | 02/27414 | A1 | 4/2002 |

* cited by examiner

RADIO-CONTROLLED WRISTWATCH

CROSS REFERENCE TO RELATED APPLICATIONS

This application is a National Stage of International Application No. PCT/JP2012/056395 filed Mar. 13, 2012, claiming priority based on Japanese Patent Application No. 2011-079890, filed Mar. 31, 2011, the contents of all of which are incorporated herein by reference in their entirety.

TECHNICAL FIELD

The present invention relates to a radio-controlled wristwatch that operates using power generated by a solar cell and performs time correction based on a signal received from a satellite.

BACKGROUND ART

There are wristwatches including a solar cell and operating using power generated by the solar cell. The solar cell generates a larger amount of electrical power with increased illuminance of external light. The wristwatch stores the power generated by the solar cell in a secondary battery and operates using power supplied from the secondary battery (see, for example, Patent Literature 1).

CITATION LIST

Patent Literature

[Patent Literature 1] JP 61-241690 A

SUMMARY OF INVENTION

Technical Problem

A radio-controlled wristwatch is being studied, which receives electromagnetic waves including time information from a satellite such as a GPS satellite so as to correct time. It is sometimes difficult for this radio-controlled wristwatch to receive the signal from the satellite with sufficient intensity indoors, and hence it is desired to receive the signals from the satellite outdoors. Therefore, it is conceivable to determine that the radio-controlled wristwatch is located outdoors when the solar cell is irradiated with light having illuminance higher than a predetermined value so as to perform a process of receiving a satellite signal.

In addition, some wristwatches including a solar cell and a secondary battery as described above control to temporarily stop operation of a built-in control circuit when a battery voltage of the secondary battery is lowered, so as to avoid an abnormal stop of the control circuit due to a shortage of the battery voltage. After the operation of the control circuit is temporarily stopped, the wristwatch charges the secondary battery using power generated by the solar cell while the solar cell is being irradiated with light having illuminance higher than a predetermined value. Further, when the power stored in the secondary battery is restored to a certain extent, the control circuit is restarted. When this control is performed, the wristwatch needs to determine whether or not the solar cell is irradiated with light having illuminance higher than the predetermined value. A criterion in this case is lower than a criterion for determining whether or not the wristwatch is located outdoors as described above, and may be a degree at which the solar cell is irradiated with light from an indoor lighting fixture.

As described above, there is a case where the radio-controlled wristwatch including the solar cell is required to determine whether or not the illuminance of the light irradiating the solar cell is high on the basis of a plurality of different criteria. The present invention is made in view of this problem, and it is an object thereof to provide a radio-controlled wristwatch capable of determining whether or not the illuminance of the light irradiating the solar cell is high on the basis of a plurality of different criteria without directly measuring an output voltage value or an output current value of the solar cell.

Solution to Problem

According to the present invention, there is provided a radio-controlled wristwatch, including: a solar cell; a control circuit which stops operation under a predetermined condition; an illuminance detection circuit which outputs a signal indicating whether or not illuminance of light irradiating the solar cell is higher than a given threshold value; threshold value switching means for switching the given threshold value between a first illuminance threshold value and a second illuminance threshold value that is larger than the first illuminance threshold value; control circuit starting means for starting the control circuit in a stop state when the illuminance detection circuit outputs a signal indicating that the illuminance is higher than the first illuminance threshold value; satellite signal receiving means for receiving a satellite signal containing time information from a satellite when the illuminance detection circuit outputs a signal indicating that the illuminance is higher than the second illuminance threshold value; and time displaying means for displaying time corresponding to the time information contained in the received satellite signal.

In the above-mentioned radio-controlled wristwatch, the illuminance detection circuit may include: a first circuit element, which is connectable in parallel to the solar cell, and has a first resistance value; a second circuit element, which is connectable in parallel to the solar cell, and has a resistance value that is smaller than the first resistance value; and a comparator circuit which outputs a signal indicating whether or not an output voltage of the solar cell is higher than a predetermined threshold voltage, and the threshold value switching means may switch a circuit element to be connected in parallel to the solar cell between the first circuit element and the second circuit element so as to switch between the first illuminance threshold value and the second illuminance threshold value.

Further, in the above-mentioned radio-controlled wristwatch, the first circuit element may be a first resistor connected normally in parallel to the solar cell, the second circuit element may include the first resistor and a second resistor that is connected in parallel to the solar cell and the first resistor via a switch, and the threshold value switching means may turn the switch on and off so as to switch the circuit element to be connected in parallel to the solar cell between the first circuit element and the second circuit element.

Further, in the above-mentioned radio-controlled wristwatch, the first circuit element may be connected to the solar cell via a first switch, the second circuit element may be connected to the solar cell via a second switch, the first switch may be a normally closed switch which is turned on when the operation of the control circuit is stopped, and the second switch may be a normally open switch which is turned off when the operation of the control circuit is stopped.

Further, in the above-mentioned radio-controlled wristwatch, the illuminance detection circuit may include a comparator circuit which outputs a signal indicating whether or not an output voltage of the solar cell is higher than a given threshold voltage, and the threshold value switching means may switch a threshold voltage to be supplied to the comparator circuit between a first threshold voltage and a second threshold voltage that is higher than the first threshold voltage, so as to switch between the first illuminance threshold value and the second illuminance threshold value.

Further, in the above-mentioned radio-controlled wristwatch, the illuminance detection circuit may further include: a first constant voltage output circuit capable of supplying the comparator circuit with the first threshold voltage as the given threshold voltage; and a second constant voltage output circuit capable of supplying the comparator circuit with the second threshold voltage as the given threshold voltage, and the threshold value switching means may switch a constant voltage output circuit to supply the comparator circuit with the given threshold voltage between the first constant voltage output circuit and the second constant voltage output circuit, so as to switch between the first illuminance threshold value and the second illuminance threshold value.

Further, in the above-mentioned radio-controlled wristwatch, the first constant voltage output circuit may be connected to the comparator circuit via a third switch, the second constant voltage output circuit may be connected to the comparator circuit via a fourth switch, the third switch may be a normally closed switch which is turned on when the operation of the control circuit is stopped, and the fourth switch may be a normally open switch which is turned off when the operation of the control circuit is stopped.

Further, in the above-mentioned radio-controlled wristwatch, the threshold value switching means may switch the given threshold value among the first illuminance threshold value, the second illuminance threshold value, and a third illuminance threshold value that is larger than the first illuminance threshold value and is smaller than the second illuminance threshold value, and the radio-controlled wristwatch may further include: means for operating in a power saving state under a predetermined condition; and means for finishing operation in the power saving state when the illuminance detection circuit outputs a signal indicating that the illuminance is higher than the third illuminance threshold value.

Advantageous Effects of Invention

The radio-controlled wristwatch according to the present invention can use the plurality of different threshold values to determine whether or not the illuminance of the light irradiating the solar cell is higher than each threshold value without directly measuring the output voltage value or the output current value of the solar cell.

FIG. [12A] A flowchart illustrating an example of a process flow performed by the radio-controlled wristwatch according to the second embodiment.

FIG. [12B] A flowchart illustrating the example of the process flow performed by the radio-controlled wristwatch according to the second embodiment.

Figure 13:
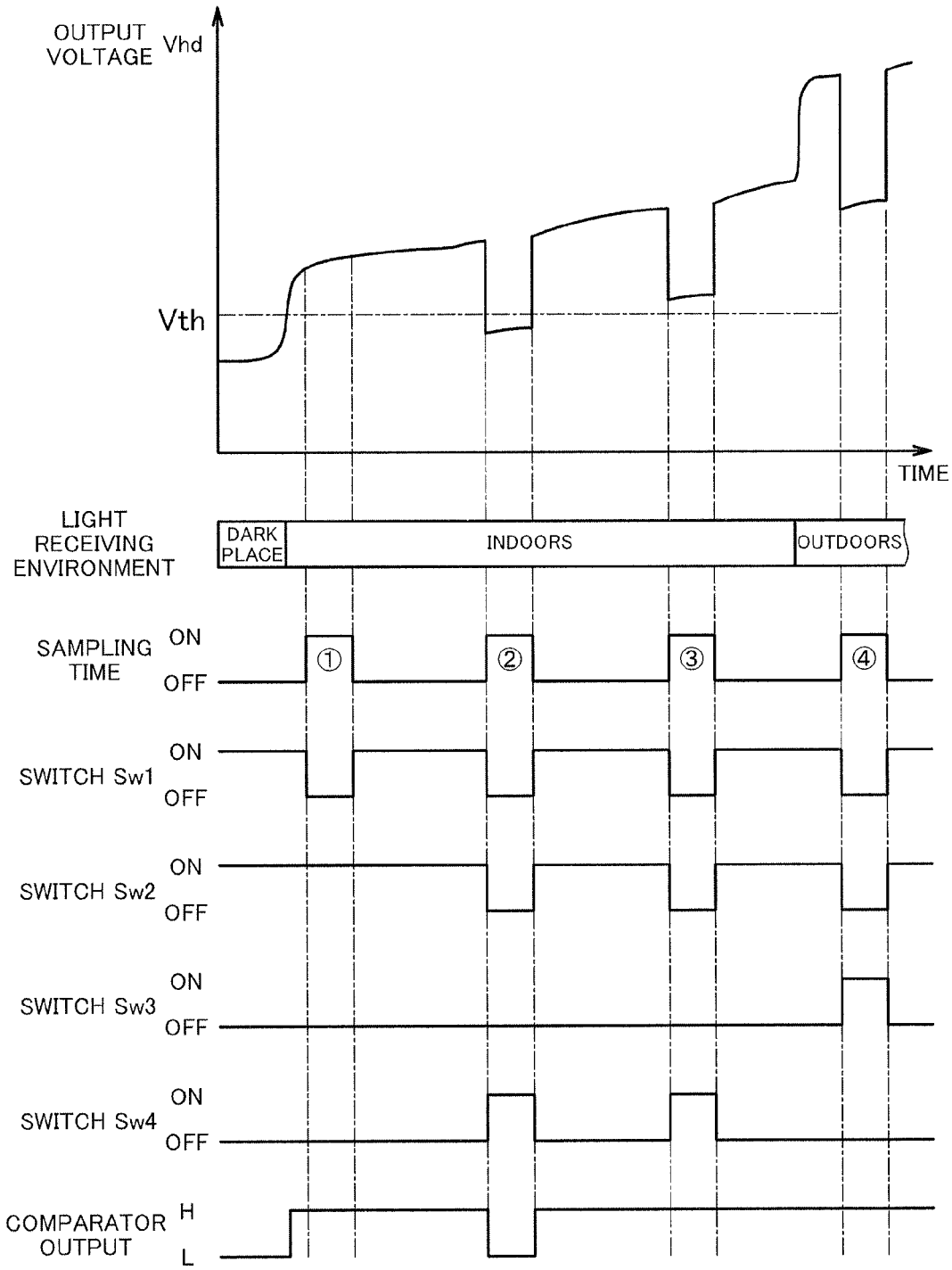

[FIG. 13] A diagram illustrating an example of a temporal change of an output voltage of a solar cell according to the second embodiment.

Figure 14:
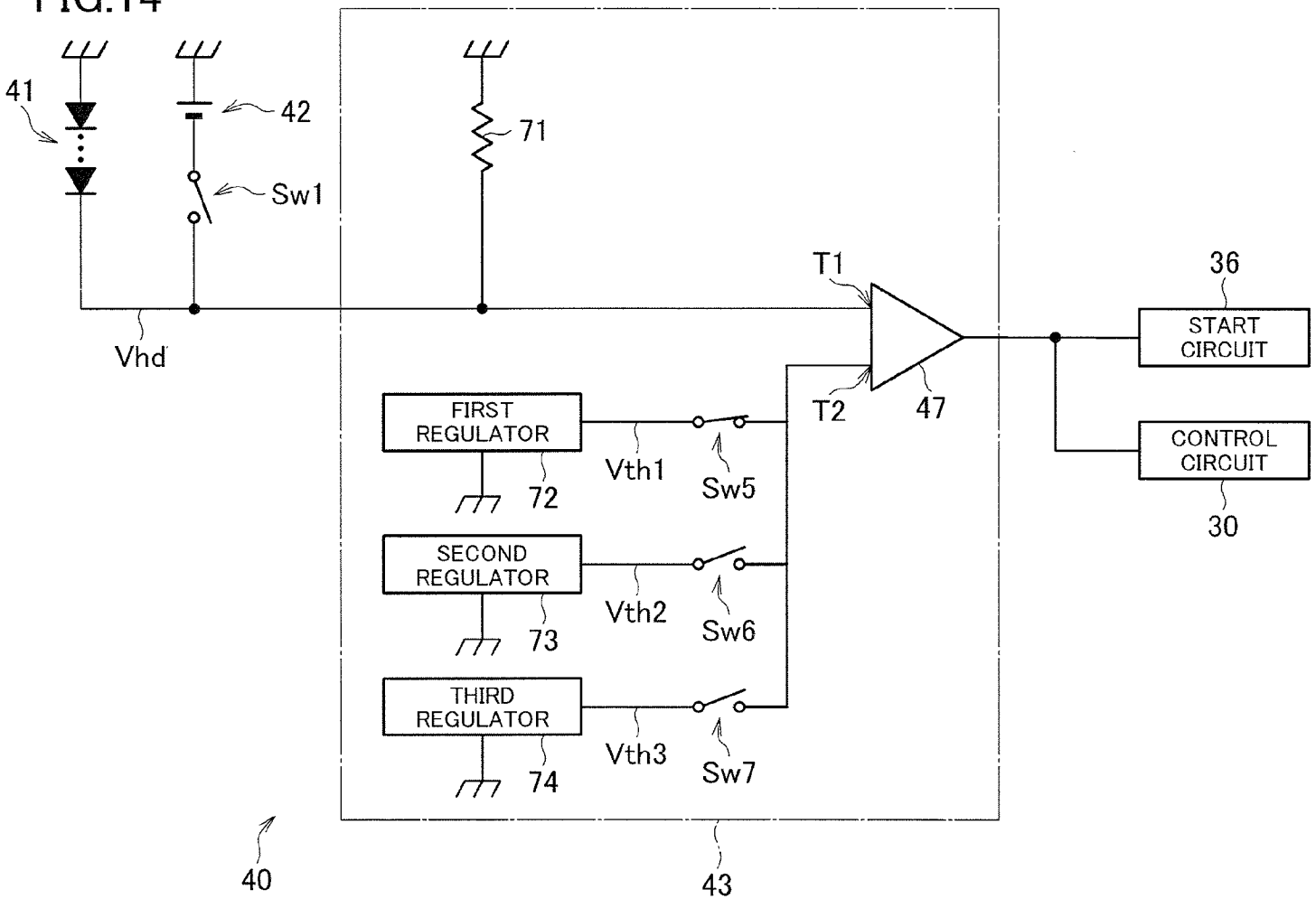

[FIG. 14] A diagram illustrating a circuit structure of a power supply unit according to a third embodiment of the present invention.

Figure 15A:
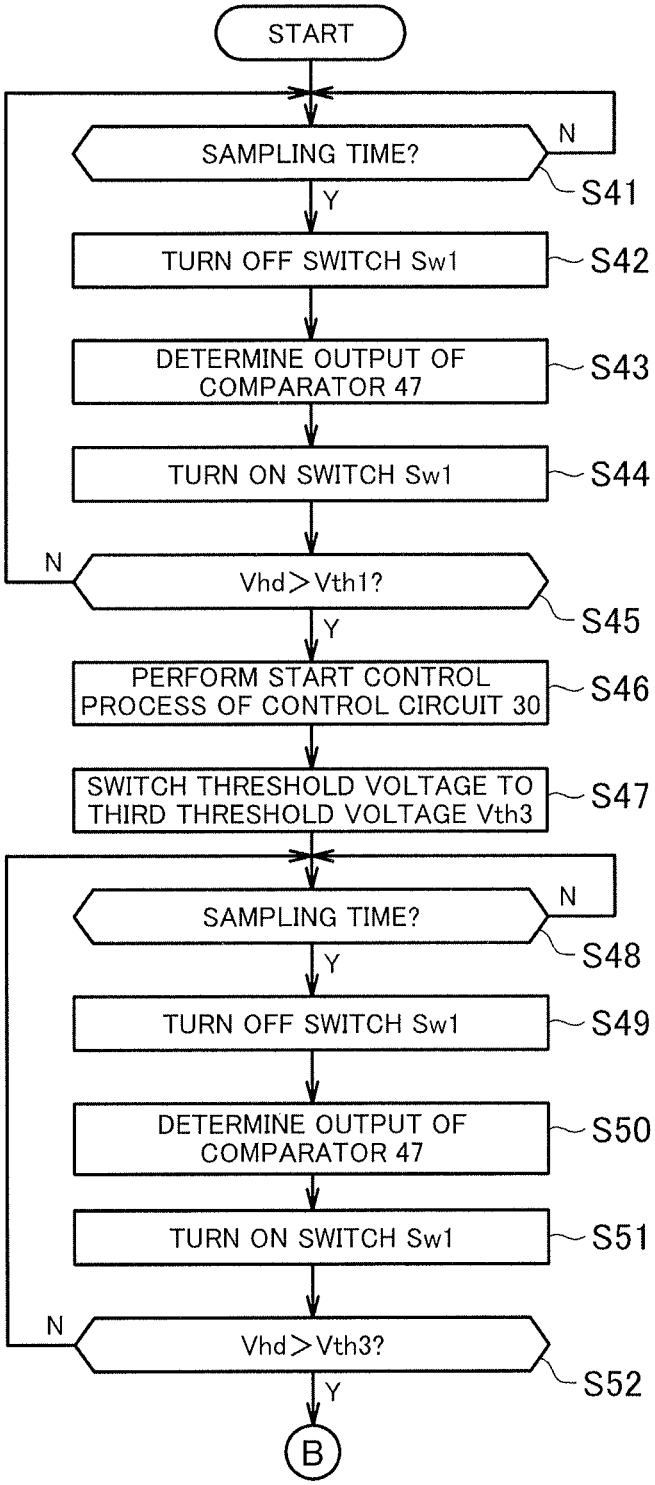

[FIG. 15A] A flowchart illustrating an example of a process flow performed by a radio-controlled wristwatch according to the third embodiment.

Figure 15B:
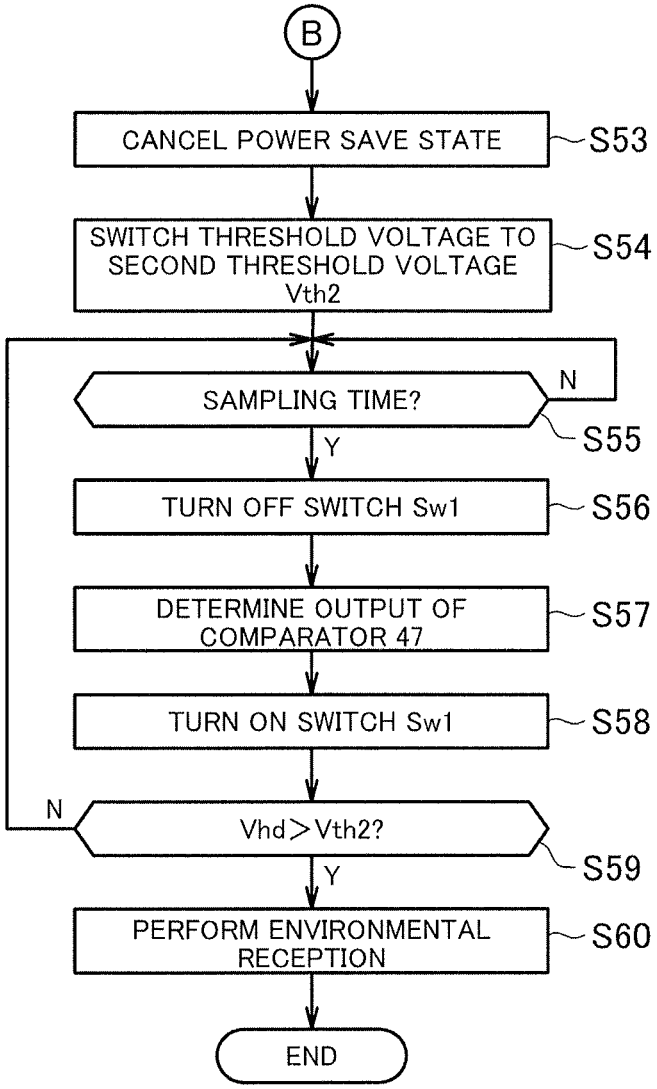

[FIG. 15B] A flowchart illustrating the example of the process flow performed by the radio-controlled wristwatch according to the third embodiment.

Figure 16:
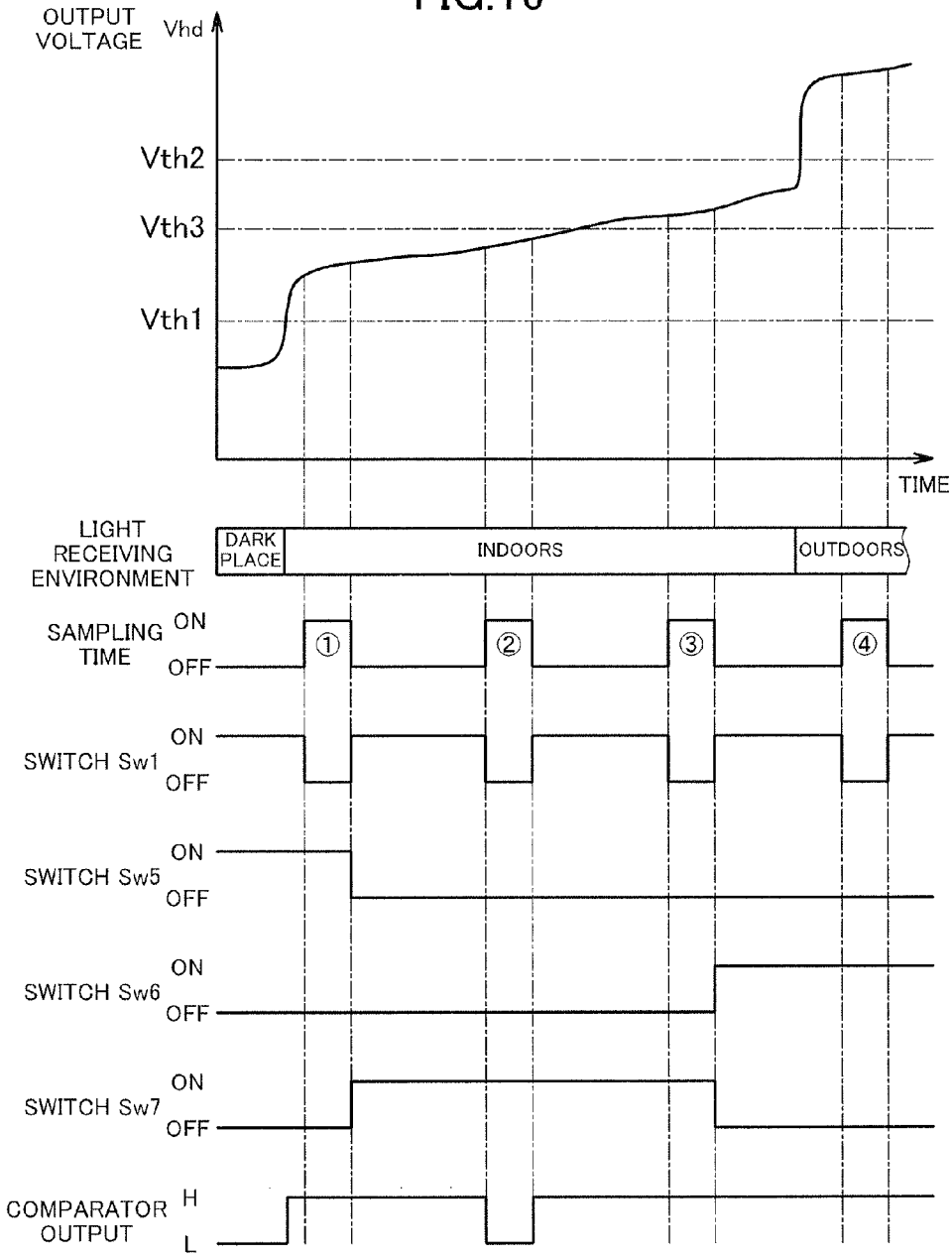

[FIG. 16] A diagram illustrating an example of a temporal change of an output voltage of a solar cell according to the third embodiment.

DESCRIPTION OF EMBODIMENTS

Now, embodiments of the present invention will be described in detail with reference to the drawings.

[First Embodiment]

Figure 1:
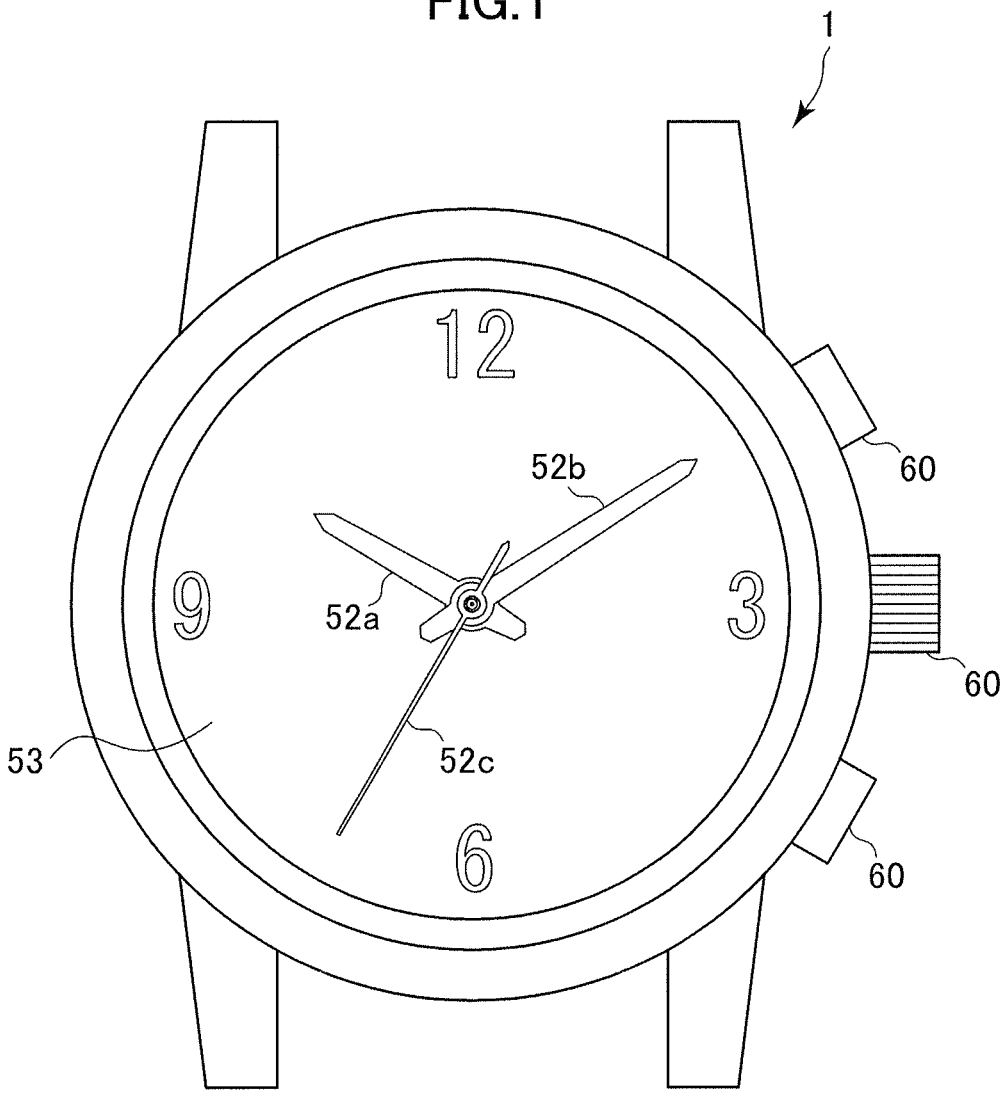
[FIG. 1] A plan view illustrating an example of an appearance of a radio-controlled wristwatch according to a first embodiment of the present invention.
Figure 2:
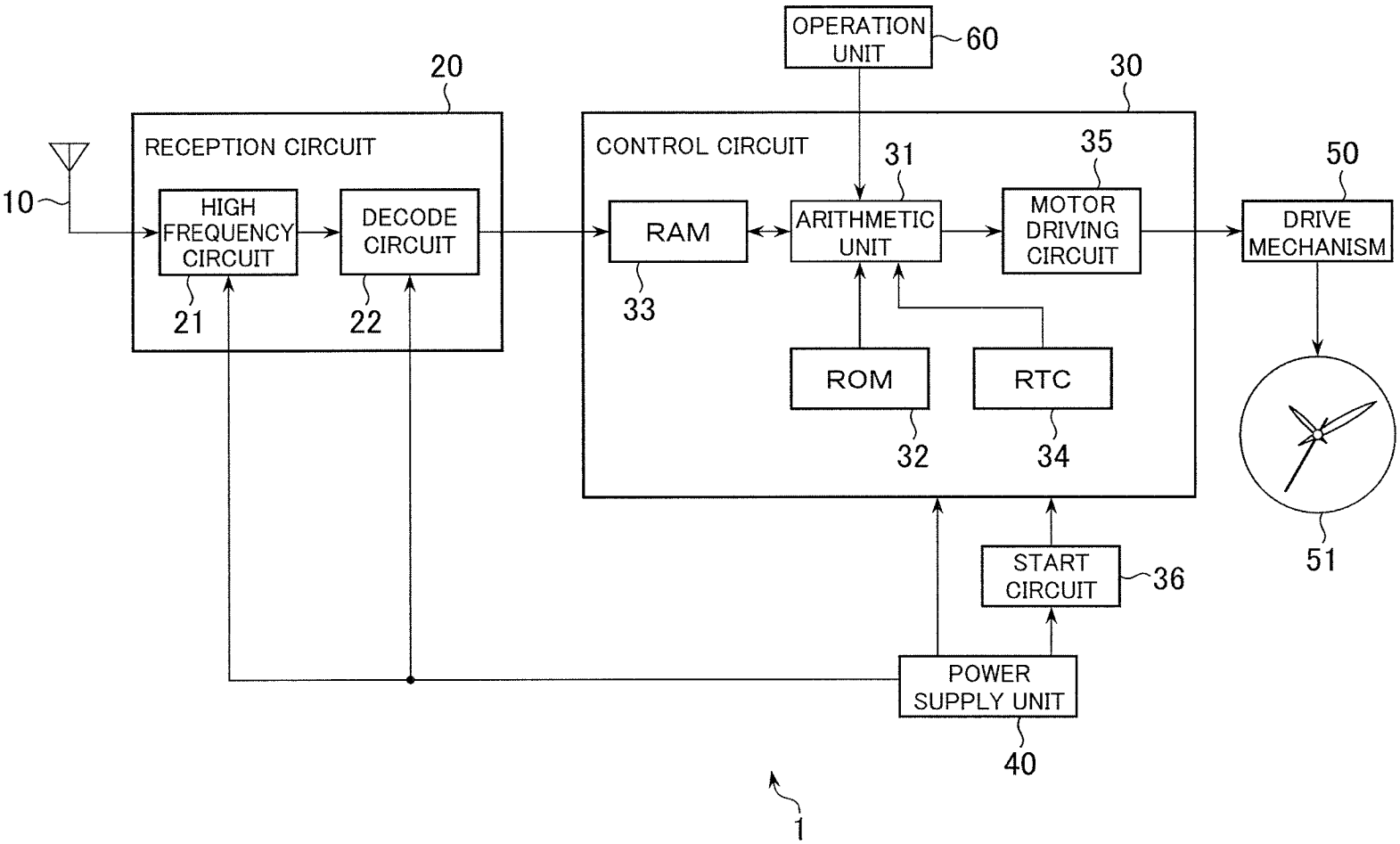
[FIG. 2] A structural block diagram illustrating an internal structure of the radio-controlled wristwatch according to the first embodiment of the present invention.

First, a radio-controlled wristwatch 1 according to a first embodiment of the present invention will be described. The radio-controlled wristwatch 1 according to this embodiment receives an electromagnetic wave containing time information and corrects the time counted by itself using the time information contained in the received electromagnetic wave. FIG. 1 is a plan view illustrating an example of an appearance of the radio-controlled wristwatch 1 according to this embodiment, and FIG. 2 is a structural block diagram illustrating an internal structure of the radio-controlled wristwatch 1. As illustrated in these diagrams, the radio-controlled wristwatch 1 includes an antenna 10, a reception circuit 20, a control circuit 30, a start circuit 36, a power supply unit 40, a drive mechanism 50, a time displaying unit 51, and an operation unit 60.

The antenna 10 receives a satellite signal transmitted from a satellite as an electromagnetic wave containing time information. Particularly in this embodiment, the antenna 10 is a patch antenna for receiving an electromagnetic wave having a frequency of approximately 1.6 GHz transmitted from a global positioning system (GPS) satellite. The GPS is one type of satellite positioning system realized by a plurality of GPS satellites orbiting around the globe. Each of these GPS satellites is equipped with a high accuracy atomic clock and periodically transmits the satellite signal containing time information measured by the atomic clock.

The reception circuit 20 decodes the satellite signal received by the antenna 10 and outputs a bit stream (received data) indicating content of the satellite signal obtained as a result of the decoding. Specifically, the reception circuit 20 includes a high frequency circuit (RF circuit) 21 and a decode circuit 22.

The high frequency circuit 21 is an integrated circuit that operates at high frequency. The high frequency circuit 21 amplifies and detects an analog signal received by the antenna 10 so as to convert the analog signal into a baseband signal. The decode circuit 22 is an integrated circuit for performing a baseband process. The decode circuit 22 decodes the baseband signal output from the high frequency circuit 21 and generates a bit stream indicating content of the data received from the GPS satellite so as to output the bit stream to the control circuit 30.

The control circuit 30 is a microcomputer or the like and includes an arithmetic unit 31, a read only memory (ROM) 32, a random access memory (RAM) 33, a real time clock (RTC) 34, and a motor driving circuit 35.

The arithmetic unit 31 performs various types of information processing in accordance with a program stored in the ROM 32. Details of the process performed by the arithmetic unit 31 in this embodiment will be described later. The RAM 33 functions as a work memory of the arithmetic unit 31, and data to be processed by the arithmetic unit 31 is written in the RAM 33. Particularly in this embodiment, the bit stream (received data) indicating content of the satellite signal received by the reception circuit 20 is sequentially written in a buffer area of the RAM 33. The RTC 34 supplies a clock signal that is used for time keeping in the radio-controlled wristwatch 1. In the radio-controlled wristwatch 1 according to this embodiment, the arithmetic unit 31 corrects internal time measured by the signal supplied from the RTC 34 on the basis of the satellite signal received by the reception circuit 20. In this way, time to be displayed on the time displaying unit 51 (display time) is determined. Further, in accordance with the determined display time, the motor driving circuit 35 outputs a drive signal for driving a motor included in the drive mechanism 50 described later. Thus, the display time generated by the control circuit 30 is displayed on the time displaying unit 51.

In this embodiment, when a battery voltage of a secondary battery 42 described later is lowered, the control circuit 30 performs a necessary process such as storing the data of the RAM 33 into a nonvolatile memory (not shown) and temporarily stops the operation, in order to avoid an unexpected operation stop. In the following description, control in which the control circuit 30 stops its operation as described above is referred to as "power break control", and a state of the radio-controlled wristwatch 1 in which the operation of the control circuit 30 is stopped by the power break control is referred to as "power break state". When the battery voltage of the secondary battery 42 is recovered to a predetermined value or higher in the power break state, the start circuit 36 supplies a control signal indicating restart of the control circuit 30 to the control circuit 30. Triggered by the input of this control signal from the start circuit 36, the control circuit 30 is restarted so that the radio-controlled wristwatch 1 resumes from the power break state to a normal operation state.

The power supply unit 40 supplies individual sections of the radio-controlled wristwatch 1 such as the reception circuit 20, the control circuit 30, and the start circuit 36 with electrical power necessary for operation thereof. A specific structure of the power supply unit 40 is described later.

The drive mechanism 50 includes a step motor that operates in accordance with the drive signal output from the above-mentioned motor driving circuit 35 and a wheel train, and the wheel train transmits rotation of the step motor so as to rotate hands 52. The time displaying unit 51 is constituted of the hands 52 and a dial plate 53. The hands 52 include an hour hand 52*a*, a minute hand 52*b*, and a second hand 52*c*. These hands 52 rotate on the dial plate 53 so as to display the current time. Further, not only a scale for time display but also a marker or the like for showing a user whether or not reception of time information has succeeded may be displayed on the dial plate 53.

The operation unit 60 is a crown, an operation button, and the like, for example, and accepts an operation by the user of the radio-controlled wristwatch 1 so as to output content of the operation to the control circuit 30. The control circuit 30 performs various processes in accordance with content of the operation input accepted by the operation unit 60.

Figure 3:
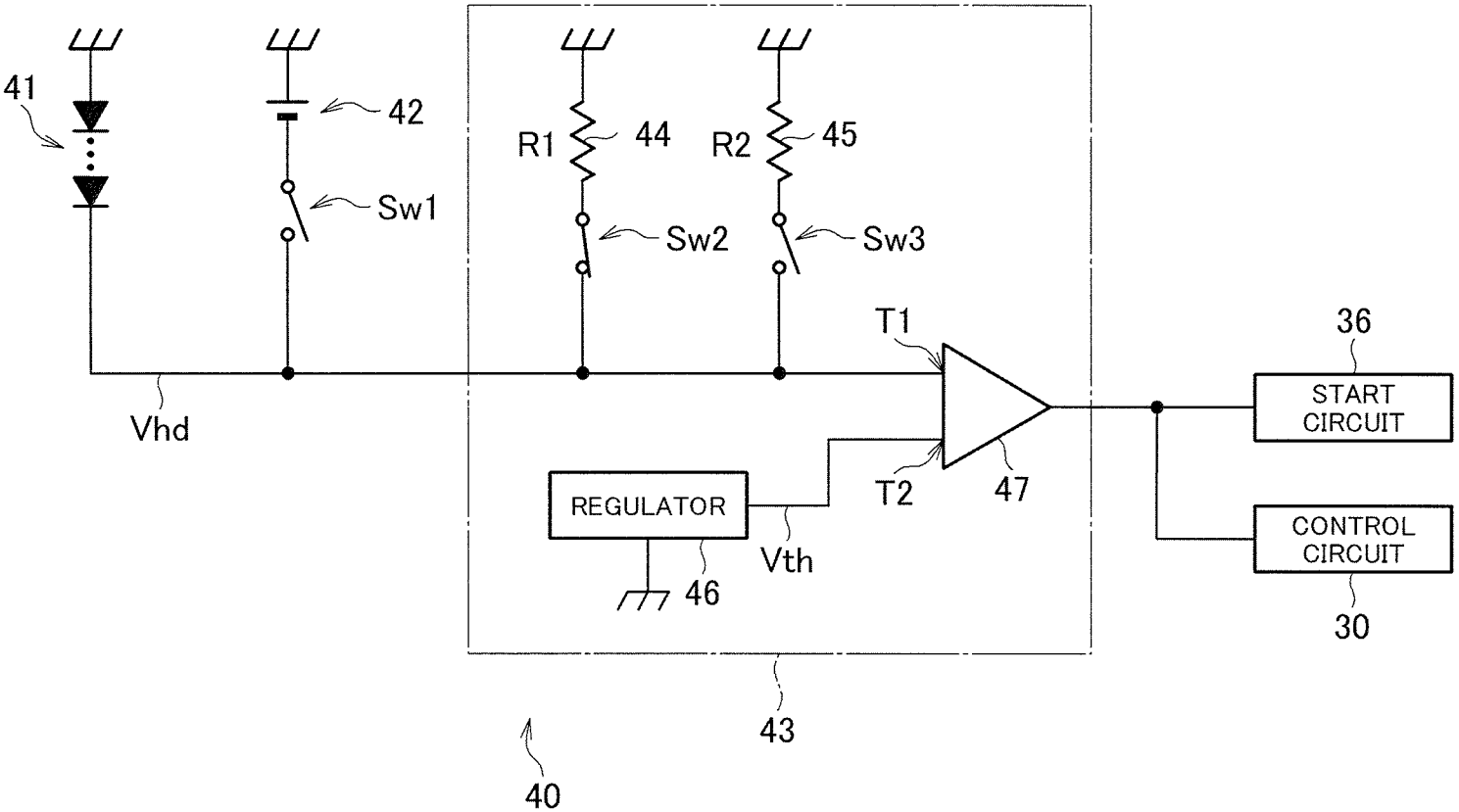
[FIG. 3] A diagram illustrating a circuit structure of a power supply unit according to the first embodiment.

Next, a circuit structure of the power supply unit 40 will be described with reference to a circuit diagram of FIG. 3. As illustrated in the diagram, the power supply unit 40 includes a solar cell 41, the secondary battery 42, an illuminance detection circuit 43, and a switch Sw1.

The solar cell 41 is disposed under the dial plate 53 and generates electrical power using external light such as solar light irradiating the radio-controlled wristwatch 1, so as to supply the generated electrical power to the secondary battery 42. Power generation amount of the solar cell 41 changes in accordance with illuminance L of the light irradiating the radio-controlled wristwatch 1.

The secondary battery 42 is a rechargeable battery such as a lithium-ion battery and stores the electrical power generated by the solar cell 41. Then, the secondary battery 42 supplies the stored electrical power to individual sections such as the reception circuit 20, the control circuit 30, and the start circuit 36, which need electrical power. Further, in FIG. 3, power supply lines from the secondary battery 42 to the individual units are not illustrated. The secondary battery 42 is connected in parallel to the solar cell 41 via the switch Sw1 connected in series. The solar cell 41 supplies power to the secondary battery 42 only in a period in which the switch Sw1 is turned on.

The illuminance detection circuit 43 detects the illuminance L of the light irradiating the solar cell 41. More specifically, the illuminance detection circuit 43 outputs a signal indicating whether or not the illuminance L is higher than a given threshold value. This threshold value is switched to one of a first illuminance threshold value Lth1 and a second illuminance threshold value Lth2 depending on a scene. Further, a magnitude relationship between these two threshold values is Lth1<Lth2. As illustrated in FIG. 3, the illuminance detection circuit 43 includes a first resistor 44, a second resistor 45, a regulator 46, a comparator 47, and switches Sw2 and Sw3.

The first resistor 44 and the second resistor 45 are pulldown resistors for controlling an output voltage Vhd of the solar cell 41 and have different resistance values. In addition, the first resistor 44 is connected in parallel to the solar cell 41 via the switch Sw2 connected in series, and the second resistor 45 is connected in parallel to the solar cell 41 via the switch Sw3 connected in series. In the following description, it is assumed that the first resistor 44 has a resistance value R1, and the second resistor 45 has a resistance value R2. A magnitude relationship between the resistance values satisfies R1>R2. In this embodiment, the first resistor 44 functions as a first circuit element, and the second resistor 45 functions as a second circuit element. In addition, in the following description, the resistor connected in parallel to the solar cell 41 at a certain time point is referred to as "resistor connected to the solar cell 41". If the switch Sw2 is turned on and the switch Sw3 is turned off, the first resistor 44 is the resistor connected to the solar cell 41. On the contrary, if the switch Sw2 is turned off and the switch Sw3 is turned on, the second resistor 45 is the resistor connected to the solar cell 41.

The regulator 46 is a constant voltage output circuit that outputs a constant voltage. In the following description, a voltage output by the regulator 46 is referred to as "threshold voltage Vth".

The comparator 47 is a comparator circuit that has two input terminals T1 and T2 and outputs a signal indicating a result of comparison between magnitudes of two input voltages. The input terminal T1 is connected to the output of the solar cell 41, and the output voltage Vhd is supplied to the input terminal T1. A value of the output voltage Vhd is determined in accordance with the illuminance L of the light irradiating the solar cell 41 and a resistance value of the resistor connected to the solar cell 41 (the first resistor 44 or the second resistor 45). In addition, the input terminal T2 is connected to the output of the regulator 46, and the threshold voltage Vth is supplied to the input terminal T2. As a result, the comparator 47 outputs a signal indicating whether or not the output voltage Vhd is higher than the threshold voltage Vth. Further, the output of the comparator 47 is connected to both the control circuit 30 and the start circuit 36. In the following description, it is assumed that the comparator 47 outputs a signal of H level when the output voltage Vhd is higher than the threshold voltage Vth and otherwise outputs a signal of L level.

The switches Sw1, Sw2, and Sw3 are complementary metal oxide semiconductor (CMOS) switches or the like, and each of the switches is turned on and off by a control signal from the control circuit 30. In addition, the switch Sw1 is also turned on and off by the control signal from the start circuit 36. The switch Sw2 is a normally closed (always closed) switch that is turned on when the operation of the control circuit 30 is stopped. In addition, the switch Sw3 is a normally open (always open) switch that is turned off when the operation of the control circuit 30 is stopped.

Figure 4:
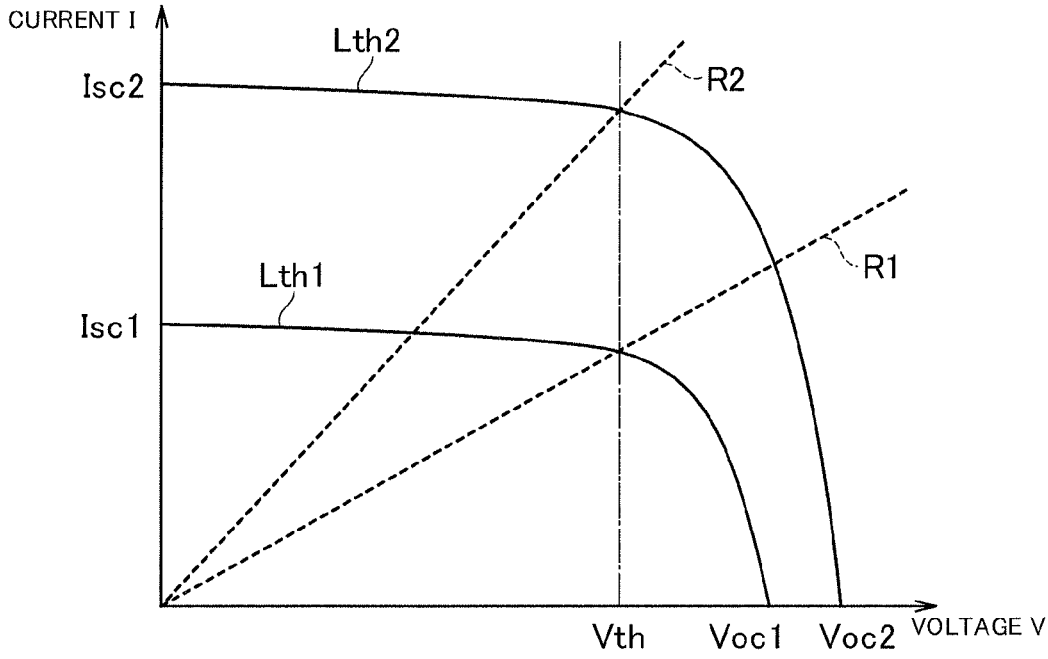
[FIG. 4] A diagram illustrating a voltage-current characteristic of a solar cell.

Now, there will be described a method of determining whether or not the illuminance L of the light irradiating the solar cell 41 is higher than each of the first illuminance threshold value Lth1 and the second illuminance threshold value Lth2 by using an output of the illuminance detection circuit 43. FIG. 4 is a graph showing a voltage-current characteristic of the solar cell 41. In the graph, the voltage-current characteristic of the solar cell 41 in a case where the illuminance L of the light irradiating the solar cell 41 is equal to the first illuminance threshold value Lth1 and that in a case where the illuminance L of the light irradiating the solar cell 41 is equal to the second illuminance threshold value Lth2 are illustrated in solid lines. Further, Voc1 and Voc2 represent open circuit voltages in the respective cases. In addition, Isc1 and Isc2 represent short circuit currents in the respective cases. As will be understood from FIG. 4, as the illuminance L becomes higher, both the open circuit voltage and the short circuit current become larger.

Further, FIG. 4 shows voltage-current characteristics of the first resistor 44 (resistance value R1) and the second resistor 45 (resistance value R2) in broken lines. An actual output voltage Vhd of the solar cell 41 is a value corresponding to the intersection between a curve indicating the voltage-current characteristic of the solar cell 41 corresponding to the illuminance L at the time and a straight line indicating a voltage-current characteristic of the resistor connected to the solar cell 41. As will be understood from the graph, if the resistor connected to the solar cell 41 is the first resistor 44, the output voltage Vhd is the same as the threshold voltage Vth when the illuminance L is equal to the first illuminance threshold value Lth1. When the illuminance L exceeds the first illuminance threshold value Lth1, the output voltage Vhd becomes higher than the threshold voltage Vth. In addition, if the resistor connected to the solar cell 41 is the second resistor 45, the output voltage Vhd becomes the same as the threshold voltage Vth when the illuminance L becomes equal to the second illuminance threshold value Lth2. When the illuminance L exceeds the second illuminance threshold value Lth2, the output voltage Vhd becomes higher than the threshold voltage Vth.

As described above, if the switches Sw1 and Sw3 are turned off and the switch Sw2 is turned on so that the solar cell 41 and the first resistor 44 are connected in parallel to each other, the output voltage Vhd exceeds the threshold voltage Vth at a time when the illuminance L exceeds the first illuminance threshold value Lth1, and hence the output of the comparator 47 is switched from L level to H level. In addition, if the switches Sw1 and Sw2 are turned off and the switch Sw3 is turned on so that the solar cell 41 and the second resistor 45 are connected in parallel to each other, the output voltage Vhd exceeds the threshold voltage Vth at a time when the illuminance L exceeds the second illuminance threshold value Lth2, and hence the output of the comparator 47 is switched to H level. Therefore, the control circuit 30 controls the switches Sw1, Sw2, and Sw3 so that the resistor connected to the solar cell 41 is switched to the second resistor 45, and hence can determine whether or not the illuminance L has exceeded the second illuminance threshold value Lth2. In addition, because the switch Sw2 is a normally closed switch and the switch Sw3 is a normally open switch, as described above, the first resistor 44 is the resistor connected to the solar cell 41 when the switch control by the control circuit 30 is not performed. Therefore, the start circuit 36 turns off the switch Sw1 and monitors the output of the comparator 47 during this period, and hence can determine whether or not the illuminance L has exceeded the first illuminance threshold value Lth1.

Figure 5:
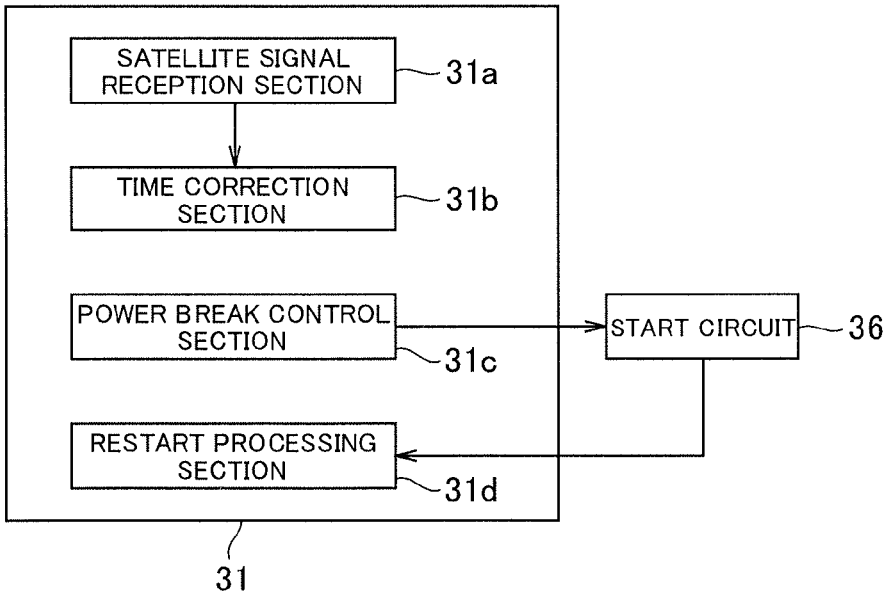
[FIG. 5] A functional block diagram illustrating functions realized by the radio-controlled wristwatch according to the first embodiment.

Now, functions realized by the arithmetic unit 31 of the control circuit 30 in this embodiment will be described. The arithmetic unit 31 executes the program stored in the ROM 32 so as to functionally realize a satellite signal reception section 31*a*, a time correction section 31*b*, a power break control section 31*c*, and a restart processing section 31*d*, as illustrated in FIG. 5.

The satellite signal reception section 31*a* receives the satellite signal transmitted from the GPS satellite so as to obtain time information contained in the signal. Further, the satellite signal reception section 31*a* may regularly perform the time information obtaining process or may perform the process in accordance with a user's operation for instructing the operation unit 60.

Particularly in this embodiment, the satellite signal reception section 31*a* also performs the process of receiving the satellite signal at a time determined in accordance with the output of the illuminance detection circuit 43. Further, in the following description, the process of receiving the satellite signal at a time determined in accordance with the output of the illuminance detection circuit 43 is referred to as "environmental reception". In this embodiment, the second illuminance threshold value Lth2 is an intermediate value between an illuminance when the radio-controlled wristwatch 1 is located outdoors and an illuminance when the radio-controlled wristwatch 1 is located indoors. Further, because it is generally brighter outdoors in the daytime even in bad weather than indoors with lighting, it is possible to set an illuminance threshold value that makes it possible to discriminate between outdoors and indoors. The satellite signal reception section 31*a* switches the resistor connected to the solar cell 41 to the second resistor 45 and monitors an output signal level of the comparator 47, and hence can determine whether or not the illuminance L of the light irradiating the solar cell 41 is higher than the second illuminance threshold value Lth2. If the illuminance L is higher than the second illuminance threshold value Lth2, it can be assumed that the radio-controlled wristwatch 1 is located outdoors. Therefore, it can be expected that the satellite signal can be received in a better reception environment than in a case where the radio-controlled wristwatch 1 is located indoors. Therefore, the satellite signal reception section 31*a* performs the environmental reception at a time when it is determined that the illuminance L is higher than the second illuminance threshold value Lth2. Further, the satellite signal reception section 31*a* may determine the time for performing the environmental reception not only on the condition that the illuminance L is higher than the second illuminance threshold value Lth2 but also in combination with another condition. For instance, the satellite signal reception section 31*a* may perform the environmental reception if a predetermined time has elapsed after the last reception process was performed and if the illuminance L is higher than the second illuminance thresholdvalue Lth2. In addition, the satellite signal reception section 31*a* may perform the environmental reception if the current time is included in a predetermined time range and if the illuminance L is higher than the second illuminance threshold value Lth2.

The time correction section 31*b* corrects the internal time measured in the radio-controlled wristwatch 1 by using information received by the satellite signal reception section 31*a* from the GPS satellite.

The power break control section 31*c* performs power break control for temporarily stopping the operation of the control circuit 30 if the battery voltage of the secondary battery 42 is equal to or lower than a predetermined value. Thus, the radio-controlled wristwatch 1 enters the power break state. Further, in this embodiment, it is assumed that a battery voltage necessary for the start circuit 36, the regulator 46, and the comparator 47 to operate also remains in the power break state. The start circuit 36 monitors a generation state of the solar cell 41 and a charging state of the secondary battery 42 in the power break state, and instructs the control circuit 30 to restart when a predetermined condition is satisfied. In addition, although not shown, in order to determine a time for performing the power break control, the radio-controlled wristwatch 1 is equipped with a voltage detection circuit that is used for measuring the battery voltage of the secondary battery 42. Using this voltage detection circuit, the time correction section 31*b* regularly measures the battery voltage of the secondary battery 42 and performs the power break control if it is detected that the battery voltage becomes equal to or lower than a predetermined value.

When the restart processing section 31*d* receives a start instruction from the start circuit 36 in the power break state, the restart processing section 31*d* performs a restart process of the control circuit 30. With this restart process, the control circuit 30 restarts so that the radio-controlled wristwatch 1 resumes from the power break state to the normal operation state. The start circuit 36 regularly determines whether or not the illuminance L of the light irradiating the solar cell 41 is higher than the first illuminance threshold value Lth1 by the method described above. Then, if it is detected that the illuminance L is higher than the first illuminance threshold value Lth1, the start circuit 36 turns on the switch Sw1 so that the solar cell 41 and the secondary battery 42 are connected to each other, and hence the secondary battery 42 is charged with power generated by the solar cell 41. Further, the start circuit 36 determines whether or not the battery voltage of the secondary battery 42 has exceeded a predetermined value. If the battery voltage has exceeded the predetermined value, the start circuit 36 inputs a control signal for instructing the control circuit 30 to restart to the control circuit 30.

Here, the reason why it is first determined whether or not the illuminance L is higher than the first illuminance threshold value Lth1, before the battery voltage of the secondary battery 42 is determined, is as follows. Specifically, if the solar cell 41 is not irradiated with a predetermined amount of light, the solar cell 41 does not generate sufficient power. In this state, even if the solar cell 41 is connected to the secondary battery 42, the secondary battery 42 is not charged, and hence there is no expectancy that the battery voltage of the secondary battery 42 will be restored to a predetermined value. On the other hand, even determining of the battery voltage of the secondary battery 42 consumes power stored in the secondary battery 42. Therefore, the start circuit 36 first determines whether or not the illuminance L is higher than the first illuminance threshold value Lth1, and charges the secondary battery 42 only in the case where the illuminance L is higher than the first illuminance threshold value Lth1. After that, the start circuit 36 determines whether or not the battery voltage of the secondary battery 42 has exceeded a predetermined value. Thus, it is possible to avoid determining the battery voltage of the secondary battery 42 in the state where there is no expectancy that the battery voltage will be restored. Further, because the first illuminance threshold value Lth1 is a threshold value for determining that the light has the illuminance L to such an extent that the solar cell 41 can generate power, the first illuminance threshold value Lth1 is smaller than the second illuminance threshold value Lth2.

Next, a specific example of a process flow performed by the radio-controlled wristwatch 1 according to this embodiment will be described with reference to a flowchart of FIG. 6. Further, in the example of this flowchart, it is assumed that the radio-controlled wristwatch 1 is in the power break state when the process is started.

In the power break state, the start circuit 36 performs sampling of the illuminance L of the light irradiating the solar cell 41 at a predetermined time interval. Specifically, the start circuit 36 waits for a predetermined sampling time (51) and then turns off the switch Sw1 (S2). Because the switch Sw2 is turned on while the switch Sw3 is turned off in the power break state as described above, the resistor connected to the solar cell 41 is the first resistor 44 in this state. Next, the start circuit 36 determines the output signal level of the comparator 47 (S3) and turns on the switch Sw1 again (S4).

If the output signal determined in S3 is L level ("N" in S5), the illuminance L at the time point is equal to or lower than the first illuminance threshold value Lth1 so that the solar cell 41 generates little power. Therefore, the start circuit 36 returns to S1 and waits for the next sampling time. On the other hand, if the output signal of the comparator 47 is H level ("Y" in S5), the start circuit 36 performs a start control process of the control circuit 30 (S6). Specifically, the start circuit 36 determines whether or not the battery voltage of the secondary battery 42 at the time point is higher than a predetermined value. If the battery voltage is higher than the predetermined value, restart is instructed to the restart processing section 31*d* of the control circuit 30. Further, if the battery voltage is the predetermined value or lower, the start circuit 36 returns to S1 and waits for the next sampling time.

After the control circuit 30 is restarted by the process of S6, the satellite signal reception section 31*a* of the control circuit 30 performs sampling of the illuminance L at a predetermined time interval. Specifically, the satellite signal reception section 31*a* waits for a predetermined sampling time (S7) and then turns off the switches Sw1 and Sw2 and turns on the switch Sw3 so that the resistor connected to the solar cell 41 is changed to the second resistor 45 (S8). In this state, the satellite signal reception section 31*a* determines the output signal level of the comparator 47 (S9), and thereafter turns on the switches Sw1 and Sw2 and turns off the switch Sw3 again so that the resistor connected to the solar cell 41 is changed to the first resistor 44 (S10).

If the output signal determined in S9 is L level ("N" in S11), the illuminance L at the time point is the second illuminance threshold value Lth2 or lower, and hence there is high probability that the radio-controlled wristwatch 1 is located indoors. Therefore, the satellite signal reception section 31*a* returns to S7 and waits for the next sampling time. On the other hand, if the output signal of the comparator 47 is H level ("Y" in S11), it is assumed that the radio-controlled wristwatch 1 is located outdoors. Therefore, the satellite signal reception section 31*a* performs the environmental reception (S12). When the reception process is finished, the satellite signal reception section 31*a* finishes the process.

Figure 6:
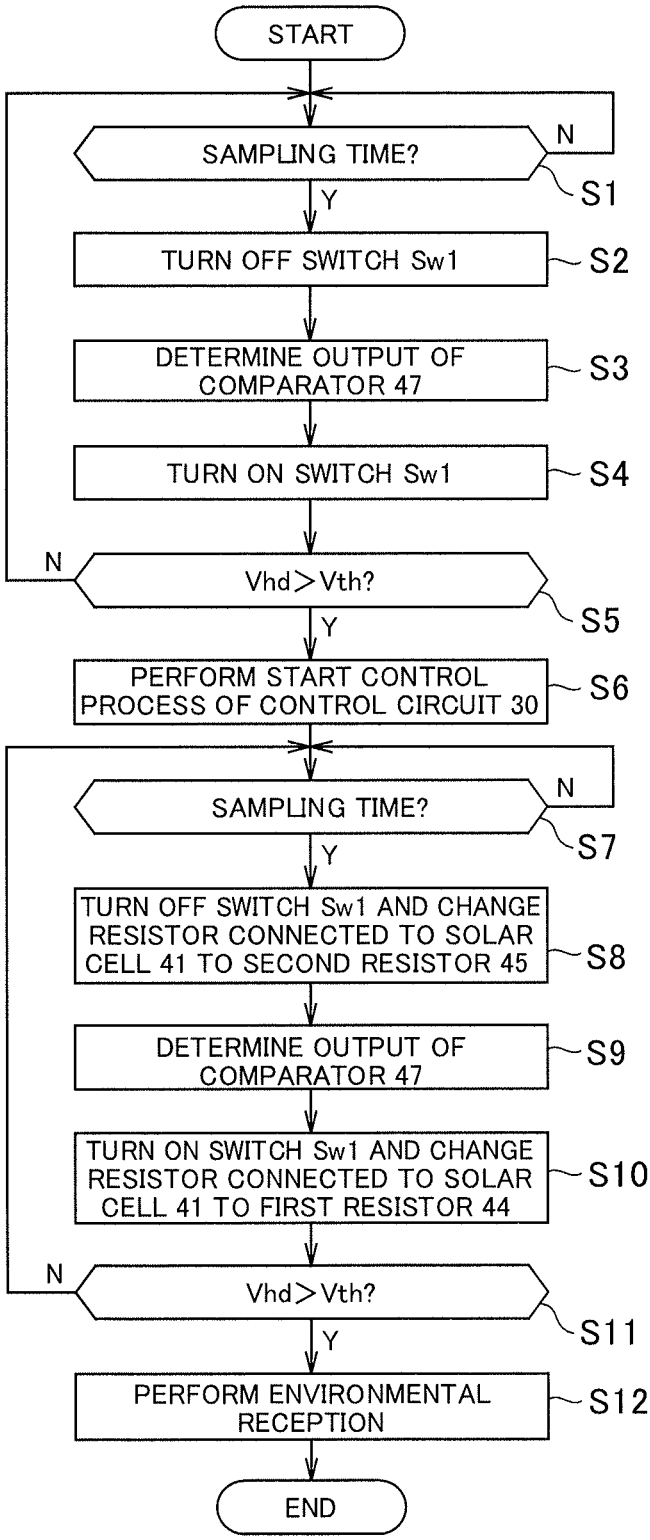
[FIG. 6] A flowchart illustrating an example of a process flow performed by the radio-controlled wristwatch according to the first embodiment.
Figure 7:
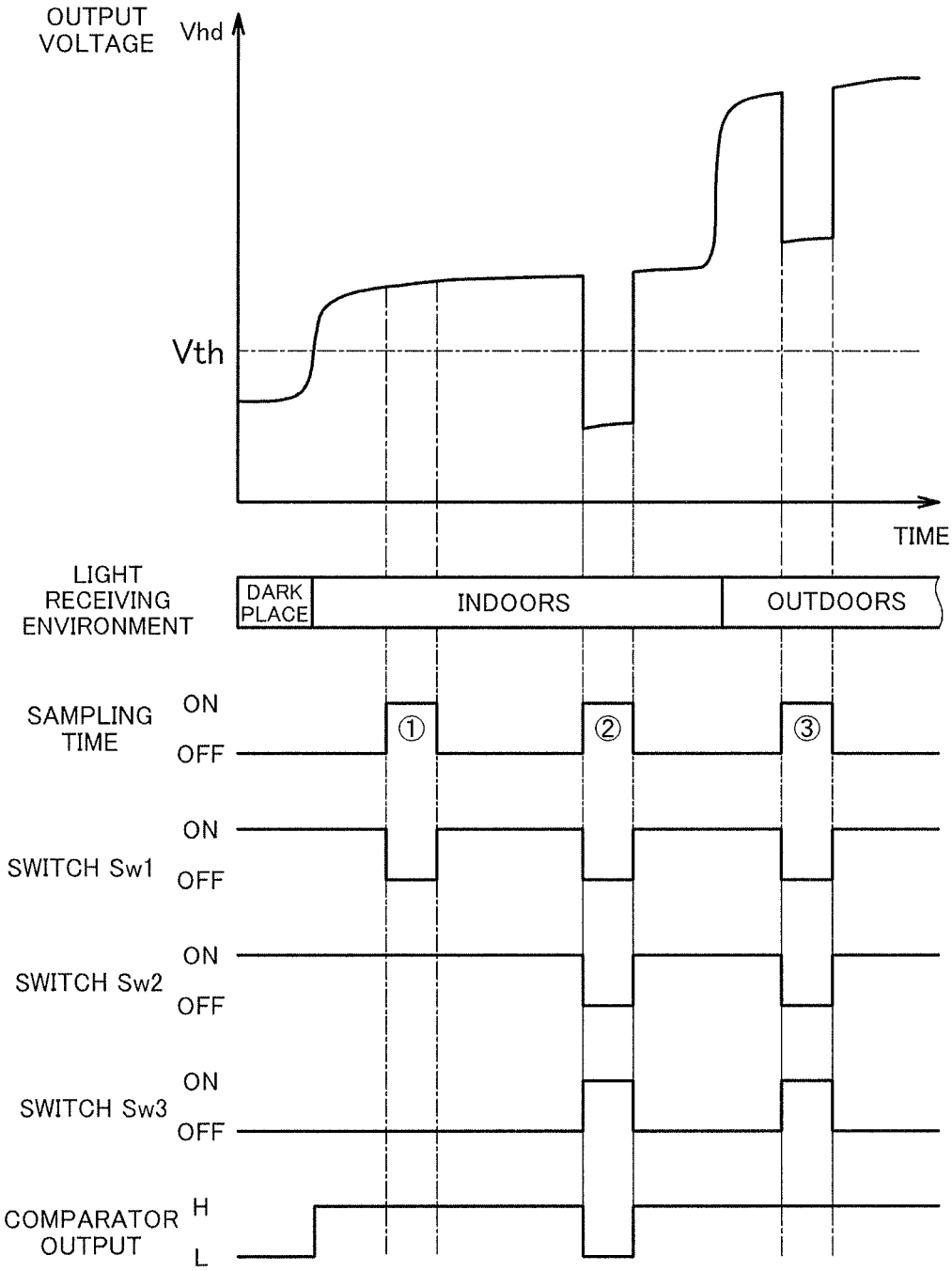
[FIG. 7] A diagram illustrating an example of a temporal change of an output voltage of the solar cell according to the first embodiment.

FIG. 7 is a diagram illustrating an example of a temporal change of the output voltage Vhd of the solar cell 41 when the process of the above-mentioned flow of FIG. 6 is performed. In addition, FIG. 7 also illustrates light receiving environment of the radio-controlled wristwatch 1, on/off states of the switches Sw1, Sw2, and Sw3, a temporal change of the output level of the comparator 47, and sampling time when the output of the solar cell 41 is sampled. Further, the output voltage Vhd actually changes in accordance with the charging state of the secondary battery 42 during a period in which the switch Sw1 is turned on, but the value illustrated here is a value assuming that the switch Sw1 is turned off (namely, a value determined only by the illuminance L and a resistance value of the resistor connected to the solar cell 41 without being affected by the secondary battery 42). The same is true for the output of the comparator 47. In this diagram, it is assumed that the radio-controlled wristwatch 1 is stored in a dark place in the power break state at a start time point (time point at an origin position in the diagram) but is moved indoors before a first sampling by the start circuit 36. Therefore, in the first sampling, the illuminance L exceeds the first illuminance threshold value Lth1 so that the output voltage Vhd exceeds the threshold voltage Vth, and hence the restart process of the control circuit 30 is performed. After that, at a second sampling time point counted from the start time point, the radio-controlled wristwatch 1 stays indoors, and the illuminance L is equal to or lower than the second illuminance threshold value Lth2. Therefore, the output voltage Vhd does not exceed the threshold voltage Vth so that the condition of the environmental reception is not satisfied. Further, after that, before a third sampling, the radio-controlled wristwatch 1 is carried outdoors. As a result, in the third sampling, it is assumed that the illuminance L exceeds the second illuminance threshold value Lth2 so that the output voltage Vhd exceeds the threshold voltage Vth.

Further, in the above description, during the period in which the output of the comparator 47 is not sampled, the switch Sw2 is turned on and the switch Sw3 is turned off so that the first resistor 44 is connected in parallel to the solar cell 41. This is for the purpose of preventing the output voltage Vhd of the solar cell 41 from being unstable when the solar cell 41 does not generate power. By connecting the first resistor 44 having a relatively large resistance value to the solar cell 41, the output voltage Vhd of the solar cell 41 can be stabilized.

In addition, in the above description, during the period in which the output of the comparator 47 is not sampled, the switch Sw1 is always turned on so that the solar cell 41 and the secondary battery 42 are connected to each other. However, it is possible that the start circuit 36 will turn off the switch Sw1 when entering the power break state, and then turn on the switch Sw1 only in the case where the illuminance L is determined to exceed the first illuminance threshold value Lth1 by sampling the output of the solar cell 41, to thereby supply power from the solar cell 41 to the secondary battery 42. In this case, the process of S4 in the flow of FIG. 6 is omitted, and instead the start circuit 36 turns on the switch Sw1 if the determination result of S5 is "Y" so as to charge the secondary battery 42. Then, if this charging causes the battery voltage of the secondary battery 42 to exceed a predetermined value, a resume process from the power break state is performed.

In addition, in the above description, the start circuit 36 samples the illuminance L at a predetermined time interval, but instead of this, it is possible for the start circuit 36 to continuously repeat the sampling of the illuminance L. In this case, the process of S1 in the above-mentioned flow of FIG. 6 is omitted, and the start circuit 36 continuously repeats the determination as to whether or not the illuminance L is higher than the first illuminance threshold value Lth1 without waiting for the sampling time. Similarly, the satellite signal reception section 31*a* may also continuously repeat the determination as to whether or not the illuminance L is higher than the second illuminance threshold value Lth2 without performing the process of S7.

In addition, in the above description, the satellite signal reception section 31*a* changes the resistor connected to the solar cell 41 to the second resistor 45 only when performing sampling of the illuminance L. Specifically, in the flow of FIG. 6, the resistor connected to the solar cell 41 is switched to the second resistor 45 only during the period in which the process of S8 to S10 is performed, and in the other period, the first resistor 44 is the resistor connected to the solar cell 41. A period of time necessary for the process of S8 to S10 is usually 100 ms or less at longest. In this way, by keeping the period in which the second resistor 45 having a smaller resistance value R2 than the resistance value R1 of the first resistor 44 is connected to the solar cell 41 short, the radio-controlled wristwatch 1 according to this embodiment can suppress power consumption due to large current flowing via the second resistor 45 to be minimum. However, if the power consumption due to the current flowing in the second resistor 45 is small enough to be no problem, the control circuit 30 may turn off the switch Sw2 and turn on the switch Sw3 when restarting from the power break state, and after that may sample the illuminance L without switching the resistor connected to the solar cell 41. In this case, the satellite signal reception section 31*a* simply turns off the switch Sw1 so as to disconnect the secondary battery 42 without switching the switches Sw2 and Sw3. Thus, it is possible to determine whether or not the illuminance L is higher than the second illuminance threshold value Lth2.

Figure 8:
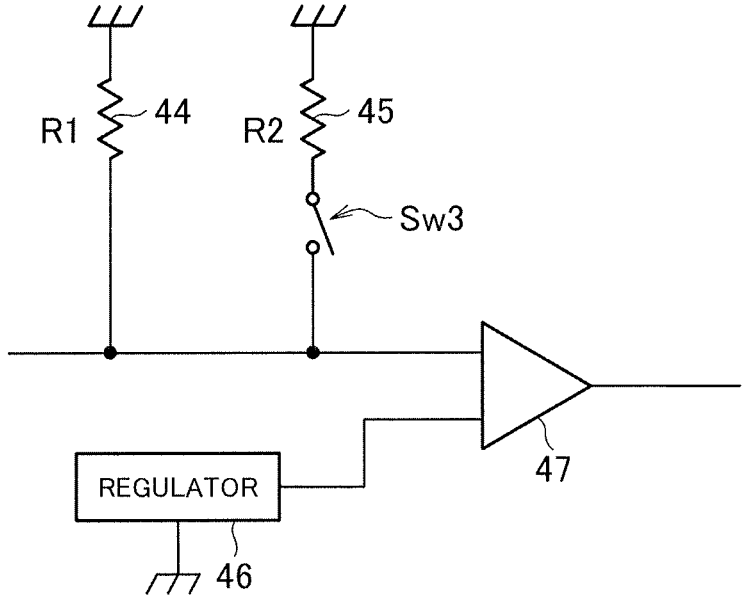
[FIG. 8] A diagram illustrating a variation example of an illuminance detection circuit.

In addition, in the above description, the switch Sw2 is connected in series to the first resistor 44, but the switch Sw2 can be eliminated. FIG. 8 illustrates a circuit structure of the illuminance detection circuit 43 in this case. In this case, when the switch Sw3 is turned off so that the second resistor 45 is disconnected, the first resistor 44 becomes the resistor connected to the solar cell 41 similarly to the above description. In other words, in this example, the first resistor 44 functions as the first circuit element by itself. On the other hand, when the switch Sw3 is turned on, unlike the above description, the first resistor 44 is not disconnected from the solar cell 41. Therefore, a combined resistance value Rc of the first resistor 44 and the second resistor 45 connected in parallel to each other can be regarded as a resistance value of the resistor connected in parallel to the solar cell 41. In other words, in this example, the first resistor 44 and the second resistor 45 connected in parallel to each other function as the second circuit element as a whole. In this case, the resistance value R2 of the second resistor 45 is determined so that the output voltage Vhd determined in accordance with the illuminance L and the combined resistance value Rc becomes equal to the threshold voltage Vth when the illuminance L is equal to the second illuminance threshold value Lth2. Thus, the illuminance detection circuit 43 can output a signal indicating a result of comparison between the illuminance L and the second illuminance threshold value Lth2. With this structure, at least the first resistor 44 is always connected in parallel to the solar cell 41 regardless of the switch control by the start circuit 36 and the control circuit 30. Therefore, the output voltage Vhd of the solar cell 41 can be stabilized. Particularly in the power break state, because the switch control by the control circuit 30 is not performed, the structure of FIG. 8 makes it possible to determine whether or not the output voltage Vhd of the solar cell 41 has exceeded the threshold voltage Vth more reliably than in the case where the first resistor 44 is connected via the switch Sw2 as illustrated in FIG. 3. In addition, because the number of components is smaller than that in the structure of FIG. 3, a mounting area can be reduced. In this example of FIG. 8, the satellite signal reception section 31*a* performs control of turning off the switch Sw1 and turning on the switch Sw3 in S8 of the above-mentioned flow of FIG. 6. Thus, a resistance value of the resistor connected to the solar cell 41 becomes the combined resistance value Rc. Similarly, control is performed to turn on the switch Sw1 and turn off the switch Sw3 in S10 of the flow of FIG. 6. Thus, the resistor connected to the solar cell 41 becomes the first resistor 44.

Figure 9:
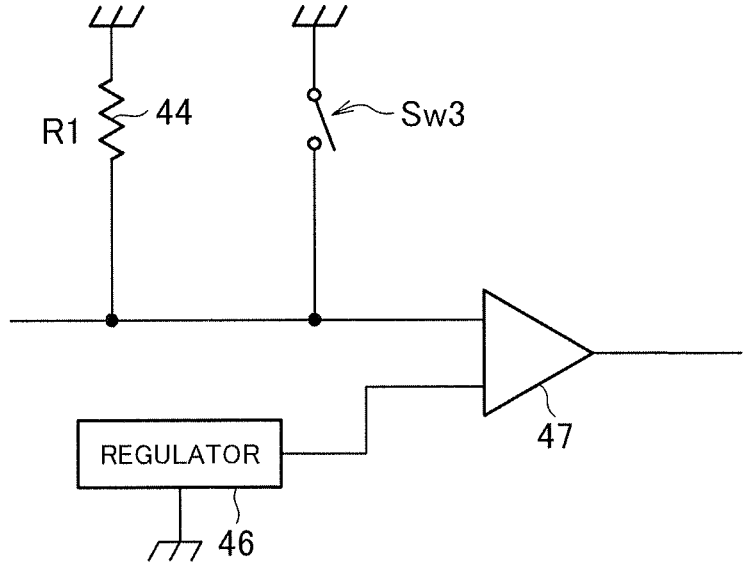
[FIG. 9] A diagram illustrating another variation example of the illuminance detection circuit.

In addition, it is possible for the illuminance detection circuit 43 to not include the second resistor 45. FIG. 9 illustrates a circuit structure of the illuminance detection circuit 43 in a case where both the switch Sw2 and the second resistor 45 are not disposed. Because the switch element such as a CMOS transistor itself has an impedance, the switch Sw2 itself can substitute for the function of the second resistor 45. In this example, the first resistor 44 functions as the first circuit element, while the first resistor 44 and the switch Sw3 connected in parallel to each other function as the second circuit element. In this case, considering a resistance value of the switch Sw2, the threshold voltage Vth is determined so that the output voltage Vhd is equal to the threshold voltage Vth if the switch Sw2 is turned on and if the irradiating light has the illuminance L equal to the second illuminance threshold value Lth2.

[Second Embodiment]

Next, a radio-controlled wristwatch according to a second embodiment of the present invention will be described. Further, in the radio-controlled wristwatch according to this embodiment, a circuit structure of the illuminance detection circuit 43 and a function realized by the control circuit 30 are different from the radio-controlled wristwatch according to the first embodiment, but a general hardware structure is the same as that of the first embodiment illustrated in FIGS. 1 and 2. Therefore, in the following description, the same component as that in the first embodiment is denoted by the same reference numeral, and detailed description thereof is omitted.

Figure 10:
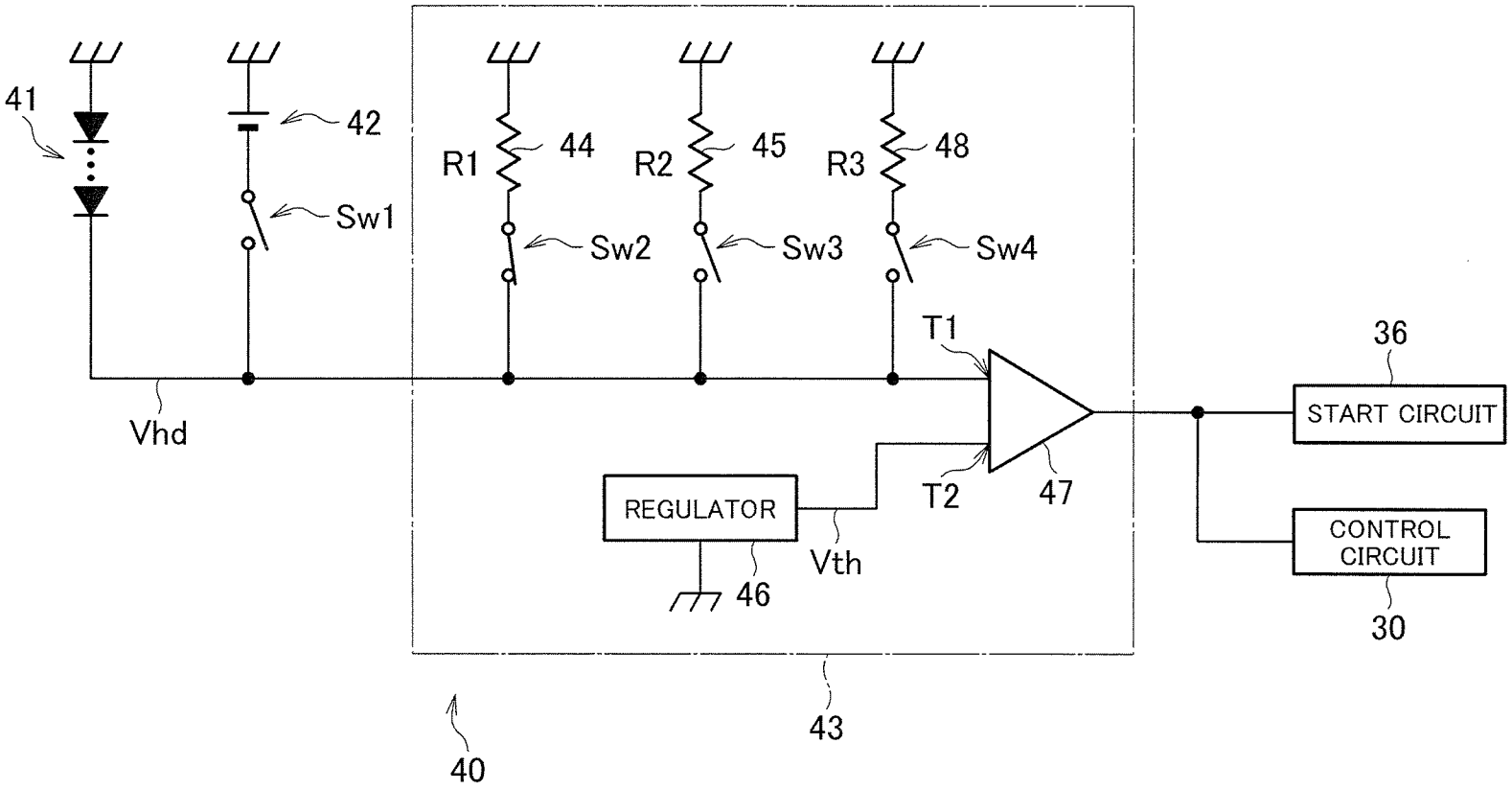
[FIG. 10] A diagram illustrating a circuit structure of a power supply unit according to a second embodiment of the present invention.

FIG. 10 is a diagram illustrating a circuit structure of the power supply unit 40 in this embodiment. As illustrated in the diagram, in this embodiment, the power supply unit 40 includes the solar cell 41, the secondary battery 42, the illuminance detection circuit 43, and the switch Sw1, similarly to the first embodiment. In addition, the illuminance detection circuit 43 includes the first resistor 44, the second resistor 45, the regulator 46, the comparator 47, the switch Sw2, and the switch Sw3, similarly to the first embodiment, and further includes a third resistor 48 and a switch Sw4. The third resistor 48 and the switch Sw4 are connected in series to each other, and are connected in parallel to the solar cell 41, the first resistor 44, the second resistor 45, and the like. The switch Sw4 is a switch element such as a CMOS switch that is turned on and off in accordance with the control signal from the control circuit 30 similarly to other switches. In addition, it is assumed that the switch Sw4 is a normally open (always opened) switch similarly to the switch Sw3, which is turned off when the operation of the control circuit 30 is stopped.

When the switches Sw1, Sw2, and Sw3 are turned off while the switch Sw4 is turned on so that the resistor connected to the solar cell 41 is switched to the third resistor 48, the output of the comparator 47 becomes H level at a time when the illuminance L of the light irradiating the solar cell 41 exceeds a third illuminance threshold value Lth3. Here, assuming that a resistance value of the third resistor 48 is R3, a magnitude relationship among resistance values of the resistors satisfies R1>R3>R2. Therefore, the third illuminance threshold value Lth3 is larger than the first illuminance threshold value Lth1 and is smaller than the second illuminance threshold value Lth2. The radio-controlled wristwatch 1 according to this embodiment controls turning on and off of each switch so that the resistor connected to the solar cell 41 is switched to one of the first resistor 44, the second resistor 45, and the third resistor 48. Thus, a comparison result can be obtained, in which the illuminance L is compared with each of the first illuminance threshold value Lth1, the second illuminance threshold value Lth2, and the third illuminance threshold value Lth3, which have different values.

Figure 11:
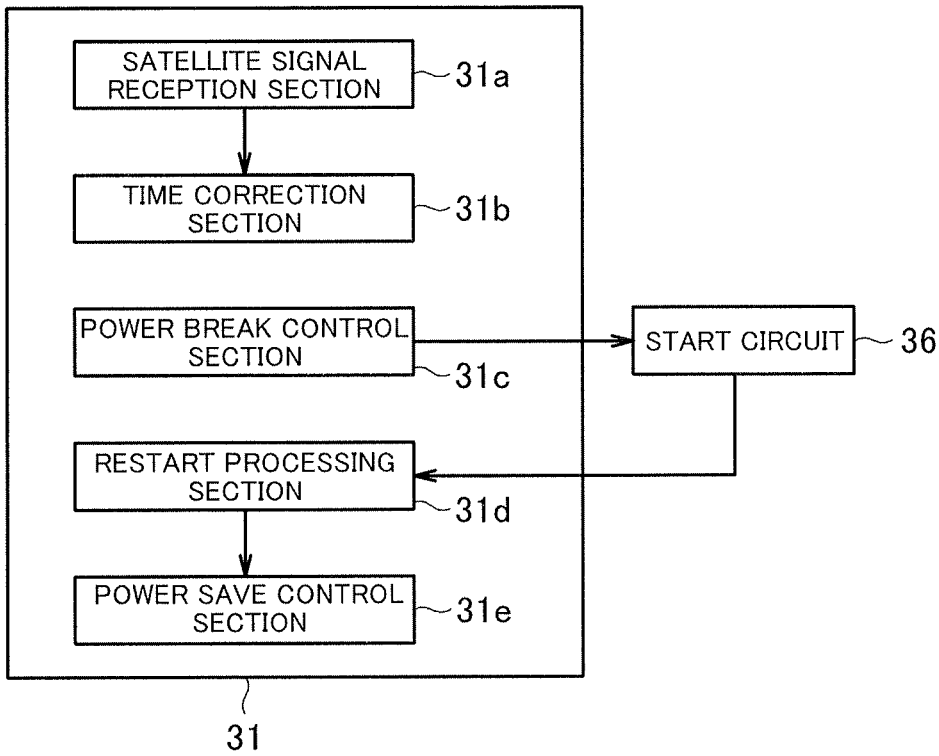
[FIG. 11] A functional block diagram illustrating functions realized by a radio-controlled wristwatch according to the second embodiment.

In this embodiment, the third illuminance threshold value Lth3 is used for determination as to whether or not to cancel power save control. In this embodiment, the arithmetic unit 31 of the control circuit 30 executes a program stored in the ROM 32 so as to realize functions of the satellite signal reception section 31*a*, the time correction section 31*b*, the power break control section 31*c*, the restart processing section 31*d*, and a power save control section 31*e* as illustrated in FIG. 11. Further, among these functions, the satellite signal reception section 31*a*, the time correction section 31*b*, the power break control section 31*c*, and the restart processing section 31*d* are the same as those of the first embodiment. Therefore, detailed descriptions thereof are omitted.

If the illuminance L of the light irradiating the solar cell 41 is equal to or lower than the third illuminance threshold value Lth3, the power save control section 31*e* stops the following operations of the hands 52 and the like so as to enter a power saving operation state (hereinafter referred to as a power save state). If the illuminance L is low, the secondary battery 42 is hardly charged, and hence a lowering of the battery voltage of the secondary battery 42 may be caused. Therefore, in this embodiment, by entering the power save state when the illuminance L is equal to or lower than the third illuminance threshold value Lth3, consumption of the secondary battery 42 can be reduced. Further, the power save control section 31*e* may enter the power save state promptly when the illuminance L becomes equal to or lower than the third illuminance threshold value Lth3 or may enter the power save state when a state where the illuminance L is equal to or lower than the third illuminance threshold value Lth3 continues for a certain period of time. In addition, if the illuminance L of the light irradiating the solar cell 41 exceeds the third illuminance threshold value Lth3 in the power save state, the power save control section 31*e* finishes the power save state and enters the normal operation state. Further, similarly to the case of entering the power save state, it is possible for the power save control section 31*e* to finish the power save state when a state where the illuminance L is higher than the third illuminance threshold value Lth3 continues for a certain period of time.

Next, a specific example of a process flow performed by the radio-controlled wristwatch 1 according to this embodiment will be described with reference to flowcharts of FIGS. 12A and 12B. Further, in this illustrated example, similarly to FIG. 6, it is assumed that the radio-controlled wristwatch 1 is in the power break state when the process is started.

First, the start circuit 36 performs the same process as that of S1 to S6 in FIG. 6. Specifically, the start circuit 36 waits for a predetermined sampling time (S21) and then turns off the switch Sw1 (S22). Here, because the switch Sw2 is turned on while the switches Sw3 and Sw4 are turned off in the power break state, the resistor connected to the solar cell 41 in this state is the first resistor 44. Next, the start circuit 36 determines the output signal level of the comparator 47 (S23), and turns on the switch Sw1 again (S24).

If the output signal determined in S23 is L level ("N" in S25), the start circuit 36 returns to S21 and waits for the next sampling time. On the other hand, if the output signal of the comparator 47 is H level ("Y" in S25), the start circuit 36 performs the start control process of the control circuit 30 (S26). Here, it is assumed that the restart of the control circuit 30 is performed by the process of S26.

In this embodiment, it is assumed that the radio-controlled wristwatch 1 is in the power save state at the time point when the control circuit 30 is restarted by the process of S26. In this state, the power save control section 31*e* performs sampling of the illuminance L at a predetermined time interval. Specifically, the power save control section 31*e* waits for a predetermined sampling time (S27) and then turns off the switches Sw1 and Sw2 while turning on the switch Sw4. Thus, the resistor connected to the solar cell 41 is changed to the third resistor 48 (S28). In this state, the power save control section 31*e* determines the output signal level of the comparator 47 (S29) and then turns on the switches Sw1 and Sw2 while turning off the switch Sw4. Thus, the resistor connected to the solar cell 41 is changed to the first resistor 44 again (S30).

If the output signal determined in S29 is L level ("N" in S31), the illuminance L at the time point is equal to or lower than the third illuminance threshold value Lth3. Therefore, the power save control section 31*e* returns to S27 and waits for the next sampling time. On the other hand, if the output signal of the comparator 47 is H level ("Y" in S31), the power save control section 31*e* performs a resume process from the power save state to the normal operation state (S32).

When the power save state is canceled, the satellite signal reception section 31*a* performs sampling of the illuminance L and performs the environmental reception if the illuminance L is higher than the second illuminance threshold value Lth2. In other words, the satellite signal reception section 31*a* performs a process similar to the process of S7 to S12 in FIG. 6. Specifically, the satellite signal reception section 31*a* waits for a predetermined sampling time (S33) and then turns off the switches Sw1 and Sw2 while turning on the switch Sw3 so that the resistor connected to the solar cell 41 is changed to the second resistor 45 (S34). In this state, the satellite signal reception section 31*a* determines the output signal level of the comparator 47 (S35) and then turns on the switches Sw1 and Sw2 while turning off the switch Sw3 so as to change the resistor connected to the solar cell 41 to the first resistor 44 (S36).

If the output signal determined in S35 is L level ("N" in S37), because the illuminance L at the time point is equal to or lower than the second illuminance threshold value Lth2, the satellite signal reception section 31*a* returns to S33 and waits for the next sampling time. On the other hand, if the output signal of the comparator 47 is H level ("Y" in S37), the satellite signal reception section 31*a* performs the environmental reception (S38). When the reception process is finished, the satellite signal reception section 31*a* finishes the process.

Figure 12A:
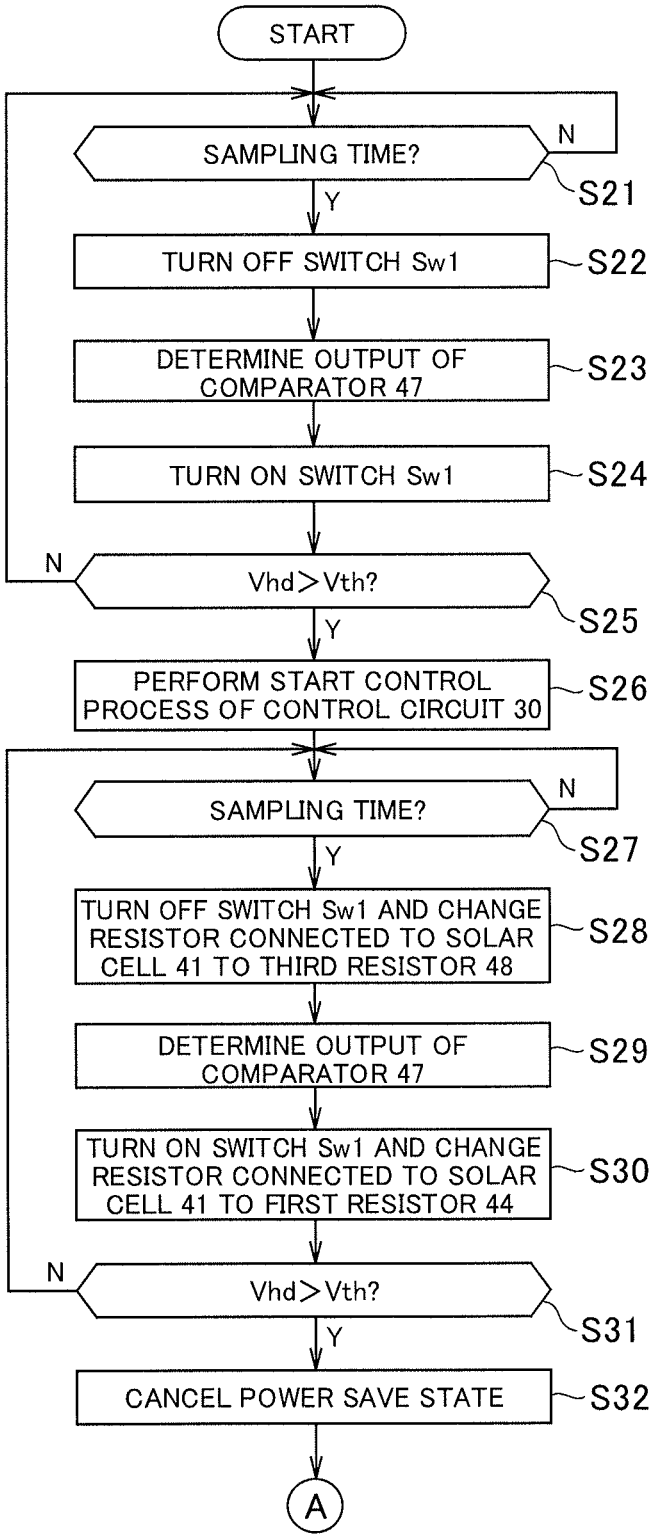
Figure 12B:
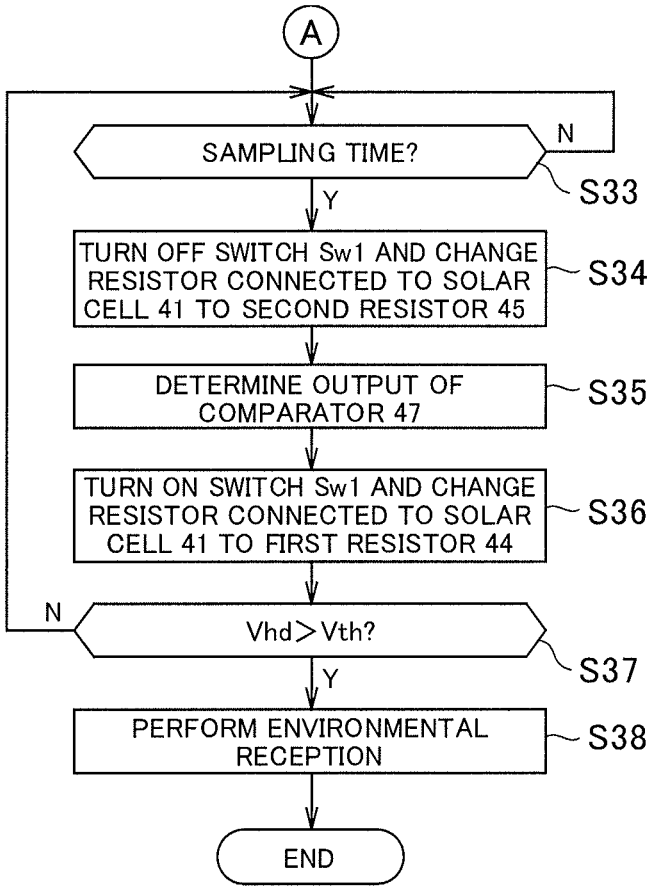

FIG. 13 is a diagram illustrating an example of a temporal change of the output voltage Vhd of the solar cell 41 in a case where the process of the above-mentioned flow of FIGS. 12A and 12B is performed. In addition, similarly to FIG. 7, FIG. 13 also illustrates the light receiving environment of the radio-controlled wristwatch 1, on/off states of the switches Sw1, Sw2, Sw3, and Sw4, a temporal change of the output level of the comparator 47, and a sampling time of the output of the solar cell 41. Further, similarly to FIG. 7, FIG. 13 illustrates the output voltage Vhd and the output of the comparator 47 assuming that the switch Sw1 is turned off. In FIG. 13, in the first sampling by the start circuit 36, it is assumed that the illuminance L exceeds the first illuminance threshold value Lth1 so that the output voltage Vhd exceeds the threshold voltage Vth, and that the restart process of the control circuit 30 is performed. In addition, it is assumed that the output voltage Vhd is equal to or lower than the threshold voltage Vth (namely, the illuminance L is equal to or lower than the third illuminance threshold value Lth3) in the second sampling by the power save control section 31*e* counted from the initial time point, and that the illuminance L exceeds the third illuminance threshold value Lth3 so that the output voltage Vhd exceeds the threshold voltage Vth in the next sampling. Further, it is assumed that the illuminance L exceeds the second illuminance threshold value Lth2 so that the output voltage Vhd exceeds the threshold voltage Vth in a fourth sampling from the initial time point by the satellite signal reception section 31*a*.

According to the radio-controlled wristwatch 1 of this embodiment described above, it is possible to determine whether or not the illuminance L has exceeded the first illuminance threshold value Lth1, the second illuminance threshold value Lth2, and in addition the third illuminance threshold value Lth3.

Further, in this embodiment, the power save control section 31*e* enters the power save state when the illuminance L of the light irradiating the solar cell 41 becomes equal to or lower than the third illuminance threshold value Lth3, and resumes from the power save state when the illuminance L exceeds the third illuminance threshold value Lth3. However, a threshold value of the illuminance L (here, referred to as "fourth illuminance threshold value Lth4") used for determining whether or not to change to the power save state may be a value different from the threshold value of the illuminance L (the third illuminance threshold value Lth3) used for determining whether or not to resume from the power save state. Particularly by setting the third illuminance threshold value Lth3 to a larger value than the fourth illuminance threshold value Lth4, it is possible to set a hysteresis in transition between the power save state and the normal operation state. In this case, in order to compare the illuminance L not only with the third illuminance threshold value Lth3 but also with the fourth illuminance threshold value Lth4, the illuminance detection circuit 43 further includes a fourth resistor (resistance value R4) and a switch, which are connected in parallel to the solar cell 41 and the like and are connected in series to each other. The resistance value R4 of this fourth resistor is set to be larger than the resistance value R3. Thus, when the fourth resistor is the resistor connected to the solar cell 41, the output voltage Vhd becomes equal to or lower than the threshold voltage Vth at a time when the illuminance L becomes equal to or lower than the fourth illuminance threshold value Lth4 (Lth4<Lth3) so that the output of the comparator 47 changes from the H level to the L level. Therefore, the power save control section 31*e* switches the resistor connected to the solar cell 41 to the fourth resistor in the normal operation state and monitors the output of the comparator 47, and hence can determine whether or not the illuminance L becomes equal to or lower than the fourth illuminance threshold value Lth4. Then, if it is detected that the illuminance L becomes equal to or lower than the fourth illuminance threshold value Lth4, the power save control section 31*e* performs a process of entering the power save state.

[Third Embodiment]

Next, a radio-controlled wristwatch according to a third embodiment of the present invention will be described. Similarly to the second embodiment, the radio-controlled wristwatch according to this embodiment can determine whether or not the illuminance L has exceeded each of the first illuminance threshold value Lth1, the second illuminance threshold value Lth2, and the third illuminance threshold value Lth3, and realizes the same function as in the second embodiment. However, a circuit structure of the illuminance detection circuit 43 in this embodiment is different from that of the first embodiment or the second embodiment, and switches a plurality of illuminance threshold values for comparison with the illuminance L by a different method from that of the radio-controlled wristwatch according to the first and second embodiments.

FIG. 14 is a diagram illustrating a circuit structure of the power supply unit 40 in this embodiment. As illustrated in the diagram, in this embodiment, the power supply unit 40 includes the solar cell 41, the secondary battery 42, the illuminance detection circuit 43, and the switch Sw1 similarly to the first embodiment and the second embodiment. On the other hand, unlike the first embodiment and the second embodiment, the illuminance detection circuit 43 includes a fixed resistor 71, three regulators including a first regulator 72, a second regulator 73, and a third regulator 74, and three switch elements including switches Sw5, Sw6, and Sw7 in addition to the comparator 47.

The fixed resistor 71 is connected in parallel to the solar cell 41 not via a switch element. Therefore, in this embodiment, this fixed resistor 71 is always the resistor connected to the solar cell 41. Further, similarly to the first embodiment and the second embodiment, the output voltage Vhd of the solar cell 41 is determined in accordance with the illuminance L of the light irradiating the solar cell 41 and a resistance value R of the fixed resistor 71, and the output voltage Vhd is supplied to the input terminal T1 of the comparator 47.

On the other hand, each of the three regulators is a constant voltage output circuit that outputs a predetermined voltage and is connected in series to a corresponding switch. In the following description, an output voltage of the first regulator 72 is referred to as "first threshold voltage Vth1", an output voltage of the second regulator 73 is referred to as "second threshold voltage Vth2", and an output voltage of the third regulator 74 is referred to as "third threshold voltage Vth3". Each of these outputs of the regulators is connected to the input terminal T2 of the comparator 47. Therefore, when one of the switches Sw5, Sw6, and Sw7 is turned on and the other two switches are turned off, only the output of one of the regulators is supplied to the input terminal T2 of the comparator 47. Further, a magnitude relationship among the first threshold voltage Vth1, the second threshold voltage Vth2, and the third threshold voltage Vth3 satisfies Vth1<Vth3<Vth2.

Because the resistor connected to the solar cell 41 is always the fixed resistor 71, the output voltage Vhd of the solar cell 41 is larger as the illuminance L of the light irradiating the solar cell 41 is higher. Therefore, by comparing this output voltage Vhd with each of the three different threshold voltages, the radio-controlled wristwatch 1 according to this embodiment can determine whether or not the illuminance L of the light irradiating the solar cell 41 has exceeded each of the three different illuminance threshold values, similarly to the second embodiment. Specifically, in this embodiment, if the illuminance L exceeds the first illuminance threshold value Lth1 when the first threshold voltage Vth1 is supplied to the input terminal T2, the output signal of the comparator 47 becomes H level. Similarly, if the illuminance L exceeds the second illuminance threshold value Lth2 when the second threshold voltage Vth2 is supplied to the input terminal T2, the output signal of the comparator 47 is switched to H level. In addition, if the illuminance L exceeds the third illuminance threshold value Lth3 when the third threshold voltage Vth3 is supplied to the input terminal T2, the output signal of the comparator 47 is switched to H level.

Further, similarly to the first embodiment and the second embodiment, in a period in which the control circuit 30 is stopped, the start circuit 36 needs to determine whether or not the illuminance L is higher than the first illuminance threshold value Lth1. Therefore, it is assumed that the switch Sw5 is a normally closed switch while the switches Sw6 and Sw7 are normally open switches so that the first threshold voltage Vth1 is supplied to the input terminal T2 during the period in which the control circuit 30 is stopped.

Next, a specific example of a process flow performed by the radio-controlled wristwatch 1 according to this embodiment is described with reference to flowcharts of FIGS. 15A and 15B. Further, in this illustrated example, similarly to the examples of FIG. 6 and FIGS. 12A and 12B, it is supposed that the radio-controlled wristwatch 1 is in the power break state when the process is started.

First, the start circuit 36 performs the same process as that of S1 to S6 in FIG. 6. Specifically, the start circuit 36 waits for a predetermined sampling time (S41) and then turns off the switch Sw1 (S42). Here, because the switch Sw5 is turned on while the switches Sw6 and Sw7 are turned off in the power break state, the first threshold voltage Vth1 is supplied to the input terminal T2 in this state. Next, the start circuit 36 determines the output signal level of the comparator 47 (S43), and turns on the switch Sw1 again (S44).

If the output signal determined in S43 is L level ("N" in S45), the start circuit 36 returns to S41 and waits for the next sampling time. On the other hand, if the output signal of the comparator 47 is H level ("Y" in S45), the illuminance L exceeds the first illuminance threshold value Lth1, and hence the start circuit 36 performs the start control process of the control circuit 30 (S46). Here, it is assumed that the restart of the control circuit 30 is performed by the process of S46.

In this embodiment, similarly to the second embodiment, it is assumed that the radio-controlled wristwatch 1 is in the power save state at the time point when the control circuit 30 is restarted by the process of S46. In this state, the power save control section 31*e* performs sampling of the illuminance L at a predetermined time interval. Specifically, the power save control section 31*e* first turns off the switch Sw5 and turns on the switch Sw7 so as to change the threshold voltage to be supplied to the input terminal T2 to the third threshold voltage Vth3 (S47). Next, the power save control section 31*e* waits for a predetermined sampling time to arrive (S48) and then turns off the switch Sw1 (S49). In this state, the power save control section 31*e* determines the output signal level of the comparator 47 (S50) and then turns on the switch Sw1 (S51).

If the output signal determined in S50 is L level ("N" in S52), the illuminance L at the time point is equal to or lower than the third illuminance threshold value Lth3. Therefore, the power save control section 31*e* returns to S48 and waits for the next sampling time. On the other hand, if the output signal of the comparator 47 is H level ("Y" in S52), the power save control section 31*e* performs a resume process from the power save state to the normal operation state (S53).

When the power save state is canceled, the satellite signal reception section 31*a* performs sampling of the illuminance L and performs the environmental reception if the illuminance L is higher than the second illuminance threshold value Lth2. Specifically, the satellite signal reception section 31*a* first turns off the switch Sw7 and turns on the switch Sw6 so as to change the threshold voltage to be supplied to the input terminal T2 to the second threshold voltage Vth2 (S54). Next, the satellite signal reception section 31*a* waits for a predetermined sampling time (S55) and then turns off the switch Sw1 (S56). In this state, the satellite signal reception section 31*a* determines the output signal level of the comparator 47 (S57) and then turns on the switch Sw1 (S58).

If the output signal determined in S57 is L level ("N" in S59), because the illuminance L at the time point is equal to or lower than the second illuminance threshold value Lth2, the satellite signal reception section 31*a* returns to S55 and waits for the next sampling time. On the other hand, if the output signal of the comparator 47 is H level ("Y" in S59), the satellite signal reception section 31*a* performs the environmental reception (S60). When the reception process is finished, the satellite signal reception section 31*a* finishes the process.

FIG. 16 is a diagram illustrating an example of a temporal change of the output voltage Vhd of the solar cell 41 in a case where the process of the above-mentioned flow in FIGS. 15A and 15B is performed. In addition, FIG. 16 also illustrates the light receiving environment of the radio-controlled wristwatch 1, on/off states of the switches Sw1, Sw5, Sw6, and Sw7, a temporal change of the output level of the comparator 47, and a sampling time of the output of the solar cell 41. Further, similarly to FIGS. 7 and 13, FIG. 16 also illustrates the output voltage Vhd and the output of the comparator 47 assuming that the switch Sw1 is turned off. In this diagram, similarly to FIG. 13, in the first sampling counted from the initial time point by the start circuit 36, it is assumed that the illuminance L exceeds the first illuminance threshold value Lth1 and accordingly the output voltage Vhd exceeds the first threshold voltage Vth1. Thus, the restart process of the control circuit 30 is performed. In addition, the illuminance L is equal to or lower than the third illuminance threshold value Lth3 in the second sampling counted from the initial time point, and therefore the output voltage Vhd is equal to or lower than the third threshold voltage Vth3. However, it is assumed that the illuminance L exceeds the third illuminance threshold value Lth3 in the next third sampling, and the output voltage Vhd exceeds the third threshold voltage Vth3. Further, it is assumed that the illuminance L exceeds the second illuminance threshold value Lth2 and thus the output voltage Vhd exceeds the second threshold voltage Vth2 in a fourth sampling counted from the initial time point.

According to the radio-controlled wristwatch 1 of this embodiment described above, similarly to the second embodiment it is possible to determine whether or not the illuminance L has exceeded each of the first illuminance threshold value Lth1, the second illuminance threshold value Lth2, and the third illuminance threshold value Lth3.

Further, in the above description, the regulator to be connected to the input terminal T2 of the comparator 47 is switched to one of a plurality of regulators that output different voltages so that the threshold voltage to be supplied to the input terminal T2 is switched to one of a plurality of voltages. However, any method can be adopted as long as the threshold voltage to be supplied to the input terminal T2 can be switched to one of a plurality of voltages. For instance, it is possible to adopt a structure in which only one constant voltage output circuit is connected to the input terminal T2 of the comparator 47, and the constant voltage output circuit switches a reference voltage output by itself to one of a plurality of threshold voltages. In this case, the constant voltage output circuit outputs any one of the first threshold voltage Vth1, the second threshold voltage Vth2, and the third threshold voltage Vth3 to the comparator 47 in accordance with an instruction from the control circuit 30. Further, in this example, when entering the power break state, the power break control section 31*c* instructs the constant voltage output circuit to change the output voltage to the first threshold voltage Vth1. Thus, during the period in which the operation of the control circuit 30 is stopped, the comparator 47 can output a result of comparison between the output voltage Vhd of the solar cell 41 and the first threshold voltage Vth1.

In addition, it is possible to supply the input terminal T2 of the comparator 47 with a voltage obtained by dividing the reference voltage output by one constant voltage output circuit with the use of a voltage dividing circuit, as the threshold voltage. The voltage dividing circuit in this case can be easily realized by two resistors connected in series to each other. Further, a voltage dividing ratio of this voltage dividing circuit can be changed by using a variable resistor as one of the resistors and by changing a resistance value thereof, for example. Thus, it is possible to supply the input terminal T2 of the comparator 47 with any one of the first threshold voltage Vth1, the second threshold voltage Vth2, and the third threshold voltage Vth3, which are different voltages, in accordance with a scene.

The invention claimed is:

1. A radio-controlled wristwatch, comprising:

a solar cell;

a control circuit which stops operation under a predetermined condition;

an illuminance detection circuit which outputs a signal indicating whether or not illuminance of light irradiating the solar cell is higher than a given threshold value;

threshold value switching means for switching the given threshold value between a first illuminance threshold value and a second illuminance threshold value that is larger than the first illuminance threshold value;

control circuit starting means for starting the control circuit in a stop state when the illuminance detection circuit outputs a signal indicating that the illuminance is higher than the first illuminance threshold value;

satellite signal receiving means for receiving a satellite signal containing time information from a satellite when the illuminance detection circuit outputs a signal indicating that the illuminance is higher than the second illuminance threshold value; and time displaying means for displaying time corresponding to the time information contained in the received satellite signal.

2. The radio-controlled wristwatch according to claim 1, wherein:

the illuminance detection circuit comprises:

a first circuit element, which is connectable in parallel to the solar cell, and has a first resistance value;

a second circuit element, which is connectable in parallel to the solar cell, and has a resistance value that is smaller than the first resistance value; and a comparator circuit which outputs a signal indicating whether or not an output voltage of the solar cell is higher than a predetermined threshold voltage; and the threshold value switching means switches a circuit element to be connected in parallel to the solar cell between the first circuit element and the second circuit element so as to switch between the first illuminance threshold value and the second illuminance threshold value.

3. The radio-controlled wristwatch according to claim 2, wherein:

the first circuit element comprises a first resistor connected normally in parallel to the solar cell;

the second circuit element comprises the first resistor and a second resistor that is connected in parallel to the solar cell and the first resistor via a switch; and the threshold value switching means turns the switch on and off so as to switch the circuit element to be connected in parallel to the solar cell between the first circuit element and the second circuit element.

4. The radio-controlled wristwatch according to claim 3, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

5. The radio-controlled wristwatch according to claim 2, wherein:

the first circuit element is connected to the solar cell via a first switch;

the second circuit element is connected to the solar cell via a second switch;

the first switch comprises a normally closed switch which is turned on when the operation of the control circuit is stopped; and the second switch comprises a normally open switch which is turned off when the operation of the control circuit is stopped.

6. The radio-controlled wristwatch according to claim 5, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

7. The radio-controlled wristwatch according to claim 2, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

8. The radio-controlled wristwatch according to claim 1, wherein:

the illuminance detection circuit comprises a comparator circuit which outputs a signal indicating whether or not an output voltage of the solar cell is higher than a given threshold voltage; and the threshold value switching means switches a threshold voltage to be supplied to the comparator circuit between a first threshold voltage and a second threshold voltage that is higher than the first threshold voltage, so as to switch between the first illuminance threshold value and the second illuminance threshold value.

9. The radio-controlled wristwatch according to claim 8, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

10. The radio-controlled wristwatch according to claim 8, wherein:

the illuminance detection circuit further comprises:

a first constant voltage output circuit capable of supplying the comparator circuit with the first threshold voltage as the given threshold voltage; and a second constant voltage output circuit capable of supplying the comparator circuit with the second threshold voltage as the given threshold voltage; and the threshold value switching means switches a constant voltage output circuit to supply the comparator circuit with the given threshold voltage between the first constant voltage output circuit and the second constant voltage output circuit, so as to switch between the first illuminance threshold value and the second illuminance threshold value.

11. The radio-controlled wristwatch according to claim 10, wherein:

the first constant voltage output circuit is connected to the comparator circuit via a third switch;

the second constant voltage output circuit is connected to the comparator circuit via a fourth switch;

the third switch comprises a normally closed switch which is turned on when the operation of the control circuit is stopped; and the fourth switch comprises a normally open switch which is turned off when the operation of the control circuit is stopped.

12. The radio-controlled wristwatch according to claim 11, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

13. The radio-controlled wristwatch according to claim 10, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

14. The radio-controlled wristwatch according to claim 1, wherein:

the threshold value switching means switches the given threshold value among the first illuminance threshold value, the second illuminance threshold value, and a third illuminance threshold value that is larger than the first illuminance threshold value and is smaller than the second illuminance threshold value; and the radio-controlled wristwatch further comprises:

means for operating in a power saving state under a predetermined condition; and means for finishing operation in the power saving state when the illuminance detection circuit outputs a signal indicating that the illuminance is higher than the third illuminance threshold value.

* * * * *